US005913760A

United States Patent [19]

Kamada et al.

[11] Patent Number: 5,913,760

[45] Date of Patent: Jun. 22, 1999

[54] TOOL SET MOUNTING METHOD

[75] Inventors: Ikuo Kamada; Satoshi Matsuura; Takiji Kitagawa, all of Ishikawa, Japan

[73] Assignee: Komatsu Ltd., Tokyo, Japan

[21] Appl. No.: 08/882,776

[22] Filed: Jul. 15, 1997

Related U.S. Application Data

[62] Division of application No. 08/553,557, filed as application No. PCT/JP94/01025, Jun. 24, 1994.

[30] Foreign Application Priority Data

| | | | |
|---|---|---|---|
| Jun. 28, 1993 | [JP] | Japan | 5-155959 |
| Aug. 10, 1993 | [JP] | Japan | 5-198400 |
| Aug. 12, 1993 | [JP] | Japan | 5-200582 |
| Sep. 17, 1993 | [JP] | Japan | 5-231639 |

[51] Int. Cl.[6] ..... B23Q 3/155

[52] U.S. Cl. ..... 483/1; 483/28

[58] Field of Search ..... 483/1, 28, 29; 83/549, 559, 563; 72/442, 444

[56] References Cited

U.S. PATENT DOCUMENTS

| | | | |
|---|---|---|---|
| 3,678,562 | 7/1972 | Leibinger | 483/28 X |
| 5,346,454 | 9/1994 | Hayashi | 483/29 |

FOREIGN PATENT DOCUMENTS

| | | | |
|---|---|---|---|
| 276391 | 8/1988 | European Pat. Off. | 483/29 |

*Primary Examiner*—William R. Briggs
*Attorney, Agent, or Firm*—Nikaido, Marmelstein, Murray & Oram LLP

[57] ABSTRACT

A punch press comprising (i) a tool set magazine that is located above a work table for supporting a workpiece and is juxtaposed with a main frame for supporting a punching head and (ii) a tool set delivery system for delivering tool sets between the tool set magazine and the punching head. A tool set mounting method comprising the steps of: (a) inserting the tool set delivery means into a tool set mounting section in a horizontal direction with a very small gap between the contact surface of an punch and its corresponding surface of the tool set mounting section opposite to the punch's contact surface and between the contact surface of a die and its corresponding surface of the tool set mounting section opposite to the die's contact surface; (b) lowering the tool set delivery means after the inserting step in such a direction that the small gap between the contact surface of the die and its corresponding surface of the tool set mounting section is eliminated; and (c) pulling the tool set delivery means out of the tool set mounting section in the horizontal direction after the lowering step while leaving the punch and die to be retained in the tool set mounting section.

5 Claims, 23 Drawing Sheets

TOOL SET MOUNTING METHOD

This is a division of application Ser. No. 08/553,557 filed Dec. 18, 1995, filed U.S. PCT/JP94/01025 on Jun. 24, 1994.

TECHNICAL FIELD

The present invention relates to a punch press in which a large number of tool sets (punch and die combination) can be stored to deal with various sorts of workpieces and which is capable of performing tool set replacement at high speeds. The invention also relates to a tool set mounting method adapted in such a punch press, for mounting a punch and a die on the tool set mounting section of the punching head.

BACKGROUND ART

Conventionally, turret punch presses are generally used as a punching machine that is able to singly produce blanks of a plurality of certain shapes. A turret punch press comprises a pair of upper and lower turrets which hold punches and dies respectively and punches a workpiece with the punch and die which have been set in positions under a hammer by indexing. The turret punch presses can deal with a comparatively small number of lots, say, 100 to 5,000 lots so that they have met so far the needs of their market as a machine tool suited for use in the small quantity production of multiple kinds of items.

In recent years, however, there have arisen strong demands in the market towards the sales of multiple items in a much smaller number of lots with short delivery times. Under such a situation, the conventional turret punch presses, which can hold up to about 70 tool sets only, can no longer meet the market demands.

To overcome this problem, one turret punch press provided with an automatic tool set replacement system has been proposed and put to practical use. According to this punching machine, a tool set storage (i.e., tool set repository) for storing a number of tool sets is incorporated in or installed separately from the turret punch press and the automatic tool set replacement system supplies tool sets to the punching head from the tool set storage.

Japanese Patent Publication No. 4-11283 (1992) discloses one example of punch presses provided with an automatic tool set replacement system. According to this publication, a magazine for storing tool sets is disposed, in the form of an arc, in the area around the center of rotation of a tool mounting/dismounting apparatus. Japanese Patent Publication Laid-Open No. 4-13424 (1992) discloses another example in which a tool set storage is disposed within a gate-like frame and a tool set replacement system is provided so as to reciprocate freely between the tool set storage and the turret. A further example is disclosed in Japanese Patent Publication Laid-Open No. 61-115630 (1986) in which a tool set magazine is so supported as to be rotatable about a horizontal, geometric axis and tool set replacement is performed by the linear, replacing motion of a tool set replacement system.

All of the prior punch presses with an automatic tool set replacement system disclosed in the above publications however fail in remarkably increasing the capacity of the tool set magazines to accommodate a large number of tool sets. In addition, the magazines of these punch presses require an extremely large space for installation if a number of tool sets are accommodated in them, which increases the distance between the punching head and the tool set storage position (i.e., the distance for tool set delivery), resulting in an increase in the time required for tool set replacement. As described above, in the prior turret punch presses equipped with an automatic tool set replacement system, if emphasis is placed on tool set replacement speed, it becomes difficult to increase the number of tool sets to be stored, and on the other hand, if emphasis is placed on the number of tool sets to be stored, tool set replacement speed decreases.

In the case of a punch press with an automatic tool set replacement system, a so-called tool set replacement operation is necessary, in which a tool set with which punching operation has been done is removed from the punching head while another tool set to be used for the next punching operation is mounted on the punching head.

One conventional example of tool set replacement systems for automatically performing such a tool set replacement operation is disclosed in Japanese Patent Publication No. 54-6751 (1979). According to the publication, a holder which is equipped with a holding mechanism for holding a tool set is inserted, in a horizontal direction, into the tool set mounting section of the punching press and while the tool set is locked by a locking device within the tool set mounting section, the holding mechanism is disengaged from the holder so that only the holder can be removed from the punch press in a horizontal direction. Japanese Patent Publication No. 4-13425 (1992) discloses another tool set replacement system which is horizontally movable to mount or dismount a tool set for replacement, and this tool set replacement system is equipped with a disengagement system for disengaging the system from the turret.

The tool set replacement system disclosed in the publication No. 54-6751 suffers from the following problem. Since a tool set is inserted only by a reciprocating motion, the gap between the tool set and the ram receiving section can be made small provided that the operator carefully inserts the tool set and makes certain by touching the tool set. However, when automatic replacement is performed, a somewhat generous gap should be kept between them, which inevitably causes backlash after mounting the tool set. Further, this system is designed to hold a tool set only by the resilient deformation of tool set holding arms and therefore positioning of the holder cannot be performed at a high speed. The tool set replacement system disclosed in the publication No. 4-13425 as mentioned above is also constructed so as to insert a tool set only by horizontal motion, so that an occurrence of backlash cannot be avoided. Another disadvantage of this system is that holders should be installed as many as tool sets.

In consideration of the foregoing problems, the invention aims to provide a compact-sized punch press which can store a large number of tool sets to cope with the small quantity production of multiple kinds of items and which ensures a tool set replacement speed as high as that of the conventional turret punch presses.

Another object of the invention is to provide a tool set mounting method by which high-speed tool set replacement can be performed without positioning the tool set delivery means with high accuracy and which prevents the tool set from contacting the tool set mounting section during insertion to eliminate the occurrence of an unpleasant sound caused by the contact between the tool set and the tool set mounting section.

DISCLOSURE OF THE INVENTION

The above objects can be achieved by a punch press according to a first aspect of the invention, the punch press comprising a tool set magazine for storing a number of tool sets and tool set delivery means for delivering the tool sets between the tool set magazine and a punching head, wherein the tool set magazine is located above a work table for supporting a workpiece and juxtaposed with a main frame for supporting the punching head.

In the punch press having the above construction, the tool set delivery means performs tool set delivery between the tool set magazine and the punching head at a high speed so that the time required for tool set replacement can be considerably reduced.

Preferably, the tool set magazine comprises a plurality of tool set holders arranged in lines along a horizontal support shaft, the lines of the tool set holders being arranged around the support shaft. In this case, each tool set holder is so supported as to be rotatable about the support shaft and holds a punch and a die assembled in a set. Such a tool set magazine is capable of densely, compactly accommodating a large number of tool sets, which shortens the traveling distance of the tool set delivery means between the tool set magazine and the punching head.

It is preferable that the tool set magazine be vertically spaced a specified distance apart from the position where the tool sets are mounted on or dismounted from the punching head such that the contour of the tool set magazine does not interfere with the workpiece being processed by the punching head. Such arrangement makes it possible to install the tool set magazine in close proximity to the punching head so as not to interfere with a workpiece. This leads to an improvement in the efficiency of tool set replacement.

The tool set delivery means is preferably disposed between the tool set magazine and the main frame so as to be movable along the support shaft of the tool set magazine. This means is preferably designed to be lifted and lowered in a vertical direction.

Preferably, the tool set loading/unloading position where tool sets are loaded in or unloaded from the tool set magazine by means of the tool set delivery means is offset toward the punching head and located above or under the support shaft of the tool set magazine. This minimizes the lifting/lowering distance of the tool set delivery means at the time of tool set replacement, thereby to reduce the time required for tool set replacement and provides constant conditions for loading or unloading of tool sets in relation to the tool set magazine, thereby to simplify the mechanism.

In this case, the tool set loading/unloading position is preferably the position where the axes of a tool set (i.e., a punch and a die) held by the tool set holder stand upright, and the tool sets are loaded or unloaded in a direction that does not cross the support shaft of the tool set magazine but extends in a plane perpendicular to the support shaft.

Further, the tool set delivery means preferably includes a hand that perform mounting/dismounting of the tool sets in relation to the punching head and loading/unloading of the tool sets in relation to the tool set magazine. As the hand for holding the tool set, two pairs of gripping mechanisms each of which can grip a tool set, i.e., a punch and a die; may be used. These gripping mechanisms are preferably positioned at the respective lead ends of two arms that are so arranged as to have a substantially V-shape together in their plan view. Each gripping mechanism preferably comprises a plurality of pairs of gripping pieces for gripping the punch and die assembled in a set. Further, each gripping piece preferably has an engagement claw that is brought into engagement with a V-shaped notch formed in each punch and die so that the punch and die are retained by the gripping piece.

Since the hand is composed of two gripping mechanisms integrally formed, the tool set to be used for the next punching operation can be mounted sequentially after removal of the tool set that has been used in the prior punching operation, by means of the rotation of the hand through a small angle. With this arrangement, not only can the time required for tool set replacement be considerably reduced but also simplified construction can be adapted for the tool set mounting/dismounting operation in relation to the punching head and for the tool set loading/unloading operation in relation to the tool set magazine.

Preferably, the tool set delivery means travels up to a projecting position which is situated beyond one edge of the main frame, and at the projecting position, the tool sets held by the tool set delivery means can be replaced. This facilitates the operation for loading a tool set from outside the punch press and the operation for replacing a worn-out tool set which has been used in the punching operation a specified number of times with new one.

The projecting position may be also utilized as the discharging position for processed materials (i.e., products or debris remaining after punching-out). With this arrangement, the tool set delivery means can be used as a material discharging means to automate discharging of materials from the work table.

According to a second aspect of the invention, there is provided a punch press comprising:

(a) a tool set magazine having a number of tool set holders which are juxtaposed in circumferential directions and axial directions of a rotatably supported, horizontal support shaft and each of which can hold a set of a punch and a die; and (b) a tool set delivery means for loading the tool sets in and unloading them from the tool set holder having a desired address in the tool set magazine.

In the invention having the above-described feature, the support shaft is rotated through a specified angle and the tool set delivery means is positioned in relation to a tool set holder having a specified address, whereby the punch and die held by the tool set holder in an assembled condition can be easily taken out. In this case, if the tool set magazine is installed in close proximity to the punching head thereby to reduce the travel distance of the tool set delivery means between the pressing head and the tool magazine, which markedly reduces the time required for tool set replacement. In the tool set magazine of the invention, tool set holders are juxtaposed in circumferential directions and axial directions of the horizontal support shaft, so that heavy-weight tool sets can be stored and arranged closely to one another in long lines parallel to the support shaft of the tool set magazine. This restricts the rotary inertia force of the tool set holders, which occurs when they rotate about the support shaft.

Preferably, the support shaft is a hollow shaft with a polygonal cross-section and tool set holding units each having a plurality of tool set holders are attached to the external surface of the support shaft. This makes the support shaft light-weight, without decreasing the mechanical strength of the support shaft and allows easy installation/removal of the tool set holding units.

Each of the tool set holding units includes a base attached to the external surface of the support shaft; a plurality of support brackets each of which projects from the base at a specified angle with respect to the circumferential direction of the support shaft; and a plurality of tool set holders each of which is attached to the lead end of each support bracket and which are juxtaposed at specified intervals. This arrangement leads to improvements in the workability and maintainability of the tool set holding units.

Preferably, each of the tool set holders includes tool set receiving members which are aligned at multiple levels to receive the tool sets. Each tool set receiving member has a tool set receiving section notched therein and the tool sets move straight ahead and laterally so that a specified portion of each punch and die is received in the corresponding tool set receiving section. Accordingly, the straight-ahead movement and lateral movement of the tool sets at the same level allow the tool sets to be received and held by the tool set holder, which facilitates loading and unloading of the tool sets.

Each tool set receiving member may include engagement means for engaging the tool set inserted in its tool set receiving section. In this case, the engagement means is preferably a leaf spring that is attached to the upper surface or lower surface of the tool set receiving member so as to be brought into engagement with the engagement recess of the punch and die. The provision of such engagement means enables it to stably hold the tool sets accommodated in the tool set holder even if the tool set holder changes in position due to the rotation of the tool set magazine.

At both sides of the tool set receiving section of the lowest tool set receiving member, fixed dogs may be provided for releasing the tool set holding force of the tool set delivery means. This arrangement enables it to automatically release the tool set holding force of the tool set delivery means simply by making the tool set delivery means close to the tool set holder when the tool sets are loaded in or unloaded from the tool set magazine, so that loading and unloading of the tool set can be automatically performed.

According to the invention, there is provided a tool set mounting method for mounting a punch and a die on the tool set mounting section of a punching head, said punch and die being assembled in a set and held by tool set delivery means, the method comprising the steps of:

(a) inserting the tool set delivery means into the tool set mounting section in a horizontal direction with a very small gap between the contact surface of the punch and the corresponding surface of the tool set mounting section opposite to the punch's contact surface and between the contact surface of the die and the corresponding surface of the tool set mounting section opposite to the die's contact surface;

(b) lowering the tool set delivery means after the inserting step in such a direction that the small gap between the contact surface of the die and the corresponding surface of the tool set mounting section opposite to the die's contact surface is eliminated; and (c) pulling the tool set delivery means out of the tool set mounting section in the horizontal direction after the lowering step while leaving the punch and die to be retained in the tool set mounting section.

According to the above method, for mounting a tool set on the tool set mounting section, a set of a punch and a die held by the tool set delivery means is inserted into the tool set mounting section while a very small gap is maintained between the contact surface of the punch and its associated surface in the tool set mounting section and the contact surface of the die and its associated surface in the tool set mounting section. Then, the tool set delivery means is lowered in such a direction as to eliminate the small gap between the contact surface of the die and its associated surface in the tool set mounting section. After the lowering step, the punch and die are held in the tool set mounting section and the tool set delivery means which has released the tool set (punch and die) from the held condition is finally pulled out in the horizontal direction to complete the tool set mounting operation.

This method not only reduces the contact sound made when the tool sets are inserted but also makes it possible to perform tool set replacement at a high speed without accurately positioning the tool set delivery means. In addition, since the level of the upper surface of the die, that is, the pass line for workpieces can be maintained constant immediately after the insertion of the tool set, damage to a workpiece can be prevented when the workpiece is laid over the die during tool set delivery.

The contact surface of the punch and its associated surface in the tool set mounting section are brought into close contact with each other by processing the workpiece with the punch.

This contact with each other may be achieved by holding the punch in the tool set mounting section. In this case, the part of the punch to be pressed when the punch is held may be tapered so that the contact surface of the punch and its associated surface in the tool set mounting section can be brought into close contact with each other.

The punch may be held in the tool set mounting section after the close contact between the contact surface of the punch and its associated surface of the tool set mounting section has been accomplished by lowering a ram disposed in the tool set mounting section by a specified amount.

Other objects of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

FIG. 1 is a plan view of the punch press according to the embodiment of the invention.

FIG. 2 is a view taken on line A—A of FIG. 1.

FIG. 3 is a right side view of the punch press shown in FIG. 2.

FIG. 4 is a partially cut-away sectional view of a tool set magazine.

FIG. 5 is a view illustrating a tool set holding unit in the tool set magazine when viewed in the direction of arrows B of FIG. 4, in the view of which some tool set holders are omitted.

FIG. 6 is a sectional view showing, in enlarged form, an essential part of the tool set holding unit of the tool set magazine.

FIG. 7(*a*) is a longitudinal sectional view of a punch.

FIG. 7(*b*) is a plan view of the punch.

FIG. 8(*a*) is a plan view of a die.

FIG. 8(*b*) is a longitudinal sectional view of the die.

FIG. 9(*a*) is a side view of the tool set holder.

FIG. 9(*b*) is a sectional view of the tool set holder taken on line C—C of FIG. 9(*a*).

FIG. 10(*a*) is a plan view showing an essential part of a first tool set receiving member in the tool set holder.

FIG. 10(*b*) is a sectional view of the first tool set receiving member taken on line D—D of FIG. 10(*a*).

FIG. 11 is a plan view showing an essential part of a second tool set receiving member in the tool set holder.

FIG. 12 is a plan view showing an essential part of a third tool set receiving member in the tool set holder.

FIG. 13 is a plan view showing an essential part of a forth tool set receiving member in the tool set holder.

FIG. 14 is a plan view showing an essential part of a fifth tool set receiving member in the tool set holder.

FIG. 15 is a plan view of a hand.

FIG. 16 is a partial sectional view of the hand taken on line E—E of FIG. 15.

FIG. 17(*a*) is an enlarged view showing an essential part of a gripping piece of the hand, for gripping the punch.

FIG. 17(*b*) is an enlarged view showing an essential part of a gripping piece of the hand, for gripping a stripper.

FIG. 17(*c*) is an enlarged view showing an essential part of a gripping piece of the hand, for gripping the die.

FIG. 18 is an enlarged partial sectional view showing a lock mechanism of the gripping pieces of the hand.

FIG. 19 is an explanatory view illustrating a tool set mounting operation.

FIG. 20 is a view taken along the direction of arrow F of FIG. 19.

FIG. 21(*a*) is a plan view of a tool set mounting section of a punching head.

FIG. 21(*b*) is a view taken along the direction of arrow G of FIG. 21(*a*).

FIG. 22 shows one example of the way of holding tool sets by the tool set holder.

FIG. 23 corresponds to FIG. 22 and shows the way of tool set holding by the first tool set receiving member of the tool set holder.

FIG. 24 corresponds to FIG. 22 and shows the way of tool set holding by the second tool set receiving member of the tool set holder.

FIG. 25 corresponds to FIG. 22 and shows the way of tool set holding by the third tool set receiving member of the tool set holder.

FIG. 26 corresponds to FIG. 22 and shows the way of tool set holding by the forth tool set receiving member of the tool set holder.

FIG. 27 corresponds to FIG. 22 and shows the way of tool set holding by the fifth tool set receiving member of the tool set holder.

FIG. 28 is a front view of a mechanism for discharging used materials.

BEST MODE FOR CARRYING OUT THE INVENTION

Figure 1:
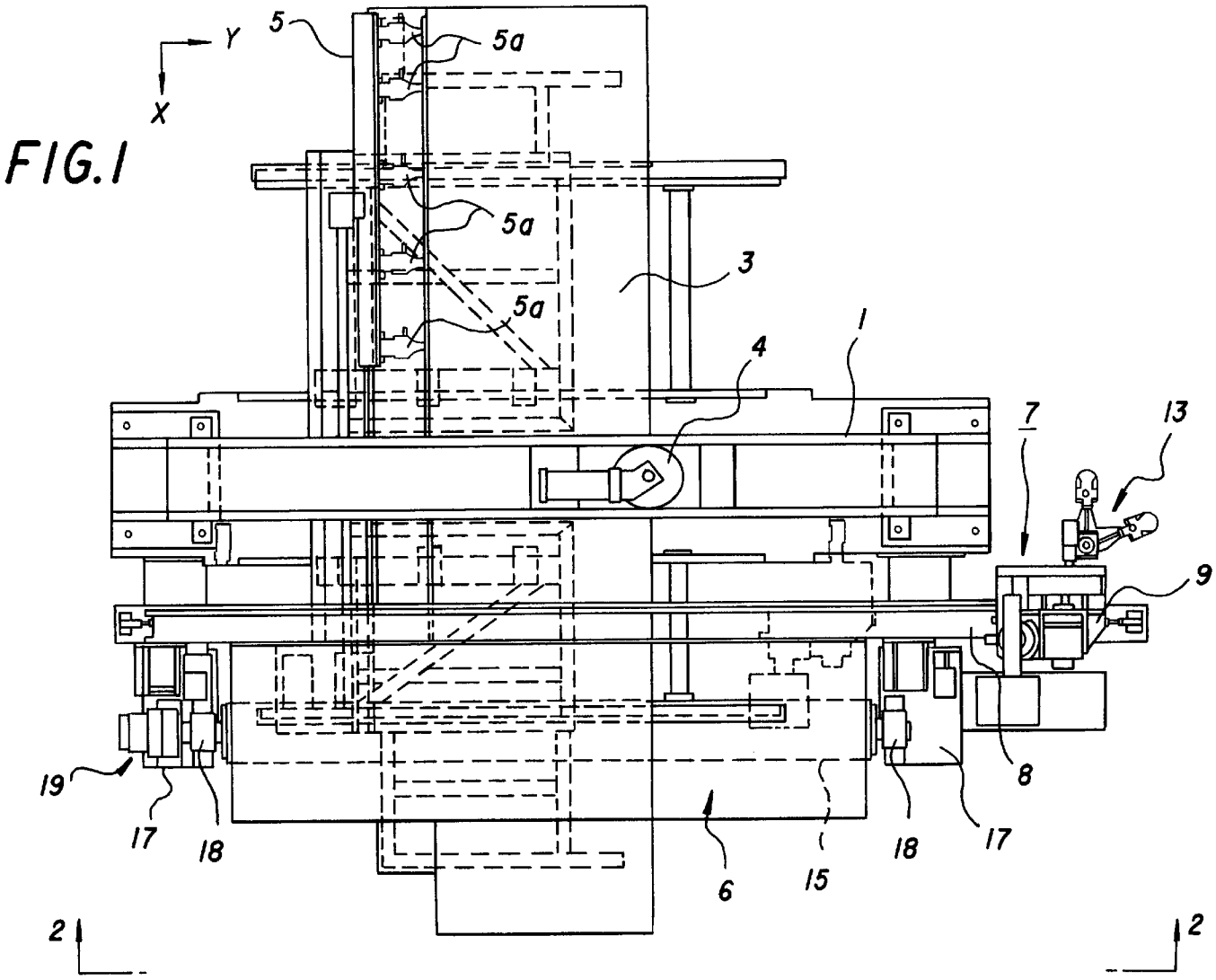
FIGS. 1 to 28 provide illustrations of a punch press and tool set mounting method according to one embodiment of the invention.

Referring now to the drawings, a punch press and a tool set mounting method will be described according to a preferred embodiment of the invention.

Figure 2:
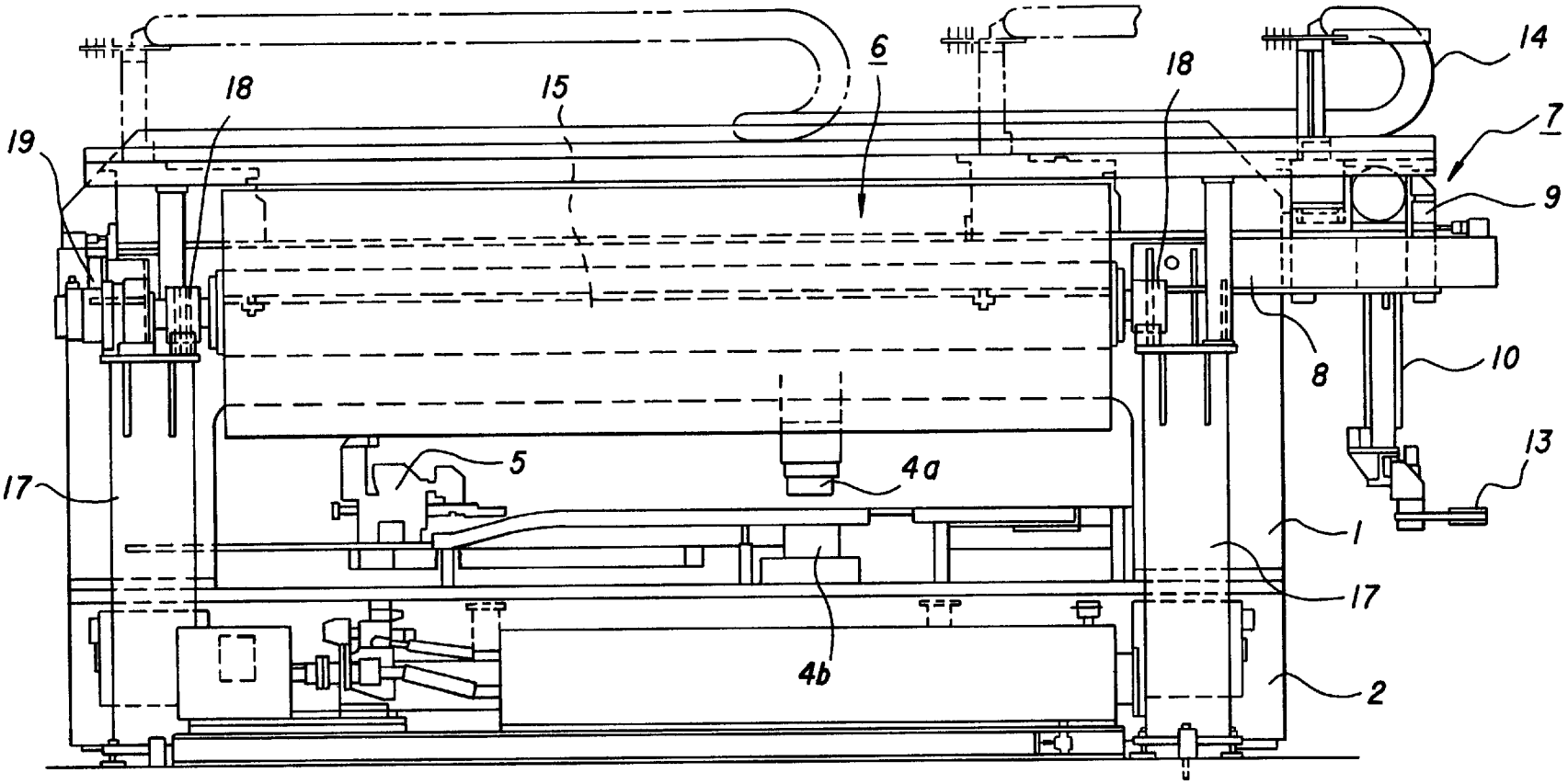
Figure 3:
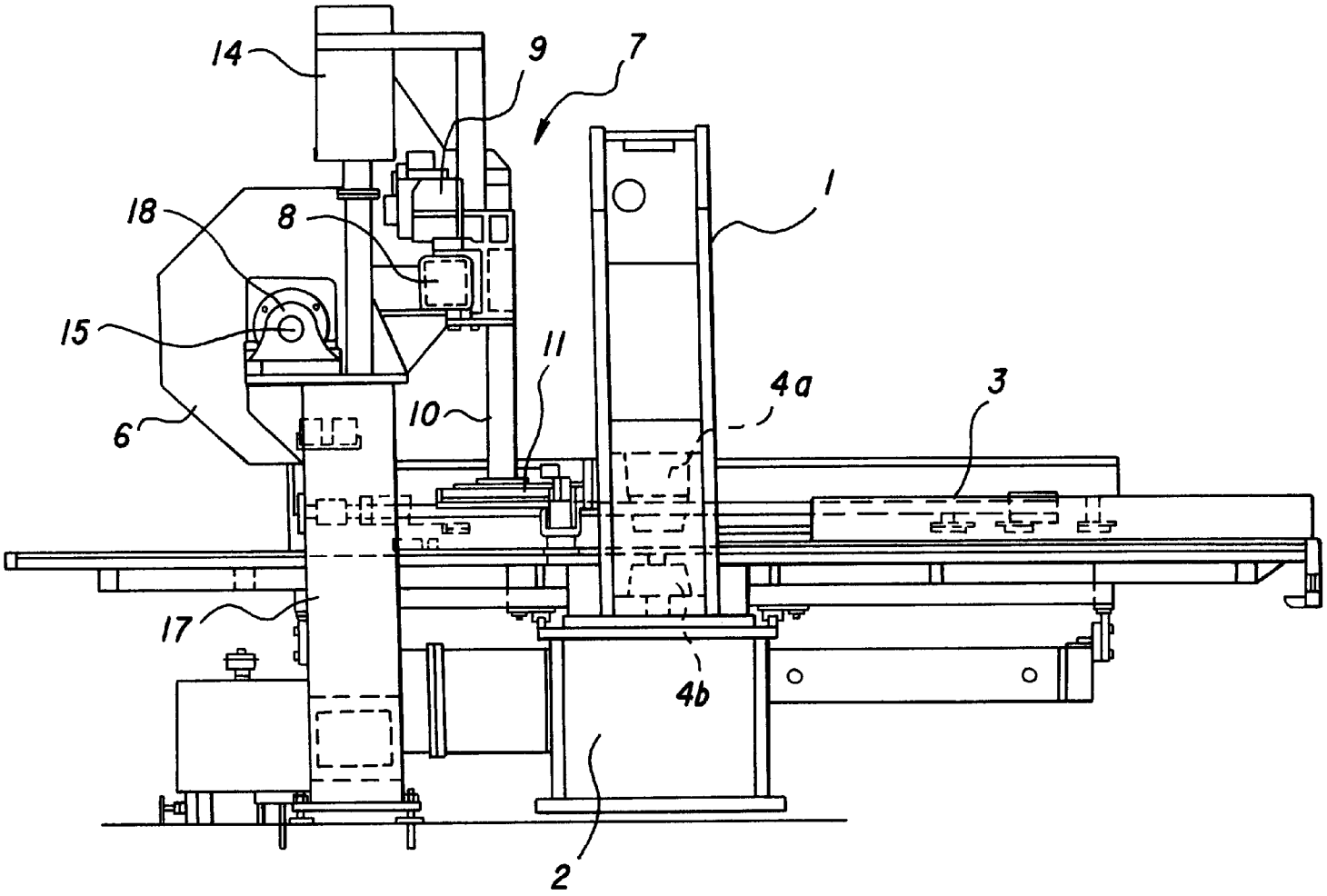

FIGS. 1 to 3 show the whole construction of a punch press according to one embodiment of the invention. In this punch press, a main frame 1 of a portal structure stands upright on a fixed bed 2 and a movable table 3 which is movable in the direction of the Y-axis (see FIG. 1) is disposed transversely to and under the main frame 1. The main frame 1 is provided with a work center 4 which is disposed at a position somewhat offset from the middle position of the main frame 1 in a longitudinal direction (to the right in FIGS. 1 and 2), with its vertical axis determined. In the work center 4, there is provided a ram (not shown) which is driven downwardly for operation and has, at the lower end thereof, a punching head 4*a* on which a punch is to be mounted. A mount table 4*b* on which a die is to be mounted is provided on the fixed bed 2 so as to face the punching head 4*a*. One side of the movable table 3 is provided with a carriage 5 that includes a work clamp 5*a* for holding a workpiece. The carriage 5 is movable on the movable table 3 in the direction of the X-axis (see FIG. 1). In the punch press having the above-described construction, a workpiece to be punched is held by the work clamp 5*a* and the position of the workpiece in the direction of the Y-axis is determined by the movement of the movable table 3 relative to the work center 4, while its position in the direction of the X-axis on the movable table 3 is determined by the movement of the carriage 5.

At a position a predetermined distance spaced from the main frame 1, a prismatic tubular (or cylindrical), tool set magazine 6 is disposed with its axis parallel to the main frame 1. Provided between the tool set magazine 6 and the main frame 1 is a tool set delivery system 7. The tool set delivery system 7 comprises (i) a rail 8 running in parallel with the tool set magazine 6 and with the main frame 1; (ii) an ATC (Automatic Tool Changer) carriage 9 movable along the rail 8; (iii) a lifting shaft frame 10 that can be lifted and lowered in relation to the ATC carriage 9; (iv) a traveling shaft frame 11 horizontally disposed at the lower end of the lifting shaft frame 10; (v) a carrier 12 (see FIG. 4) movable along the traveling shaft frame 11; and (vi) a hand 13 that is horizontally turnable through a specified angle in relation to the carrier 12. Reference numeral 14 designates a supporting means for an energy supply cable which supplies energy to the driving mechanism of the tool set delivery system 7.

The tool set magazine 6 is made in a laterally elongated form and comprises (i) a support shaft 15 disposed at the center of the tool set magazine 6; and (ii) a number of tool set holding units 16 (see FIG. 4) that are fixedly attached to the support shaft 15, being aligned on the circumference of the support shaft 15 and in the axial direction of the shaft 15. The support shaft 15 is rotatably supported at both ends thereof by means of bearings 18 to the upper parts of magazine support frames 17 which are formed separately from the main frame 1. A magazine indexing and actuating means 19 indexes the support shaft 15 to obtain rotation angles and rotates the support shaft 15 through the rotation angles.

The tool set magazine 6 is covered except for the area that extends in the axial direction of the tool set magazine 6 along a part of the rail 8 where loading/unloading of tool sets is performed by the hand 13. The tool set magazine 6 is vertically spaced a specified distance from the position where tool sets are mounted on or dismounted from the punching head 4*a* so that the periphery of the tool set magazine 6 does not interfere with the movement of a workpiece to be processed by the punching head 4*a*.

Figure 4:
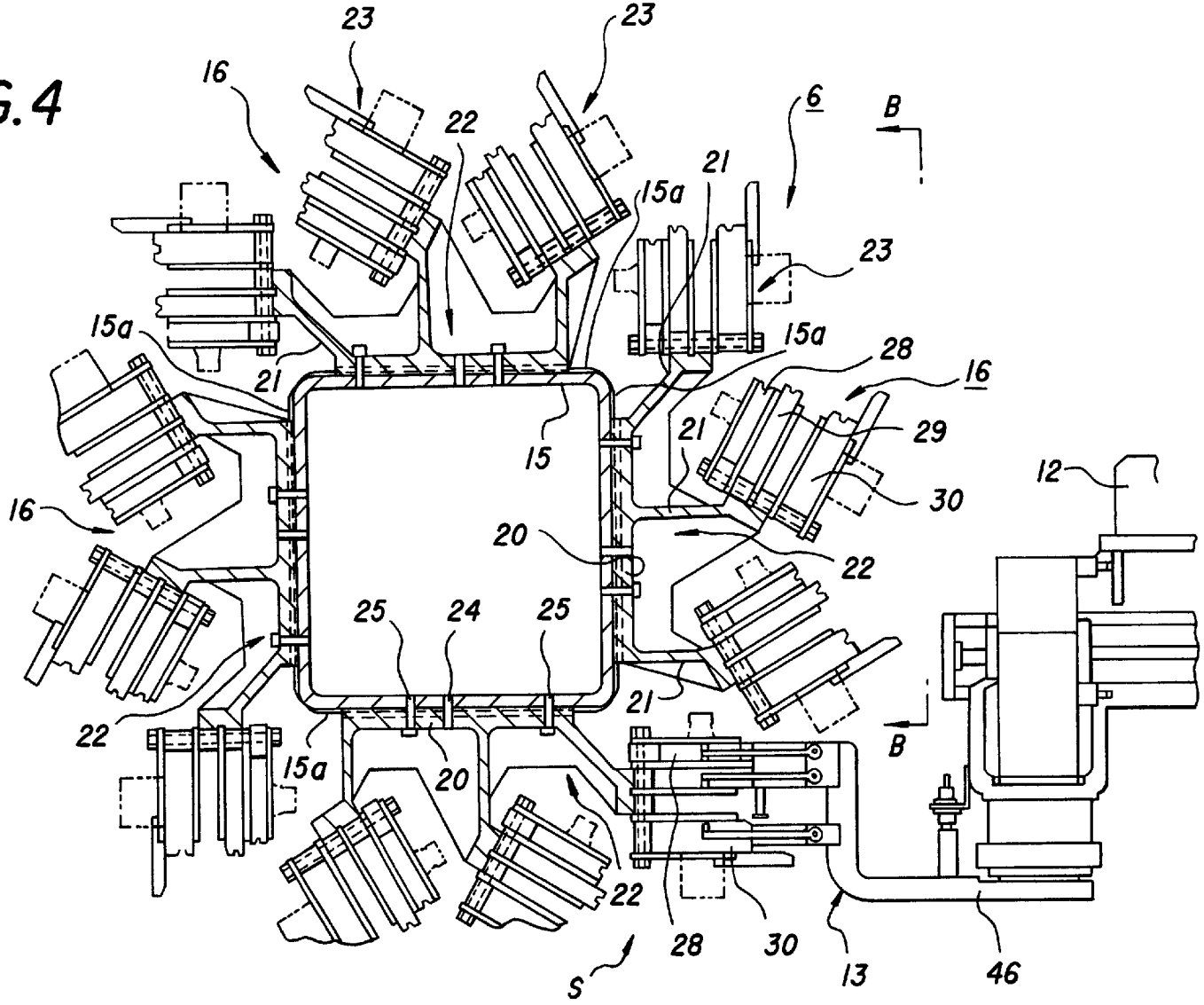
Figure 6:
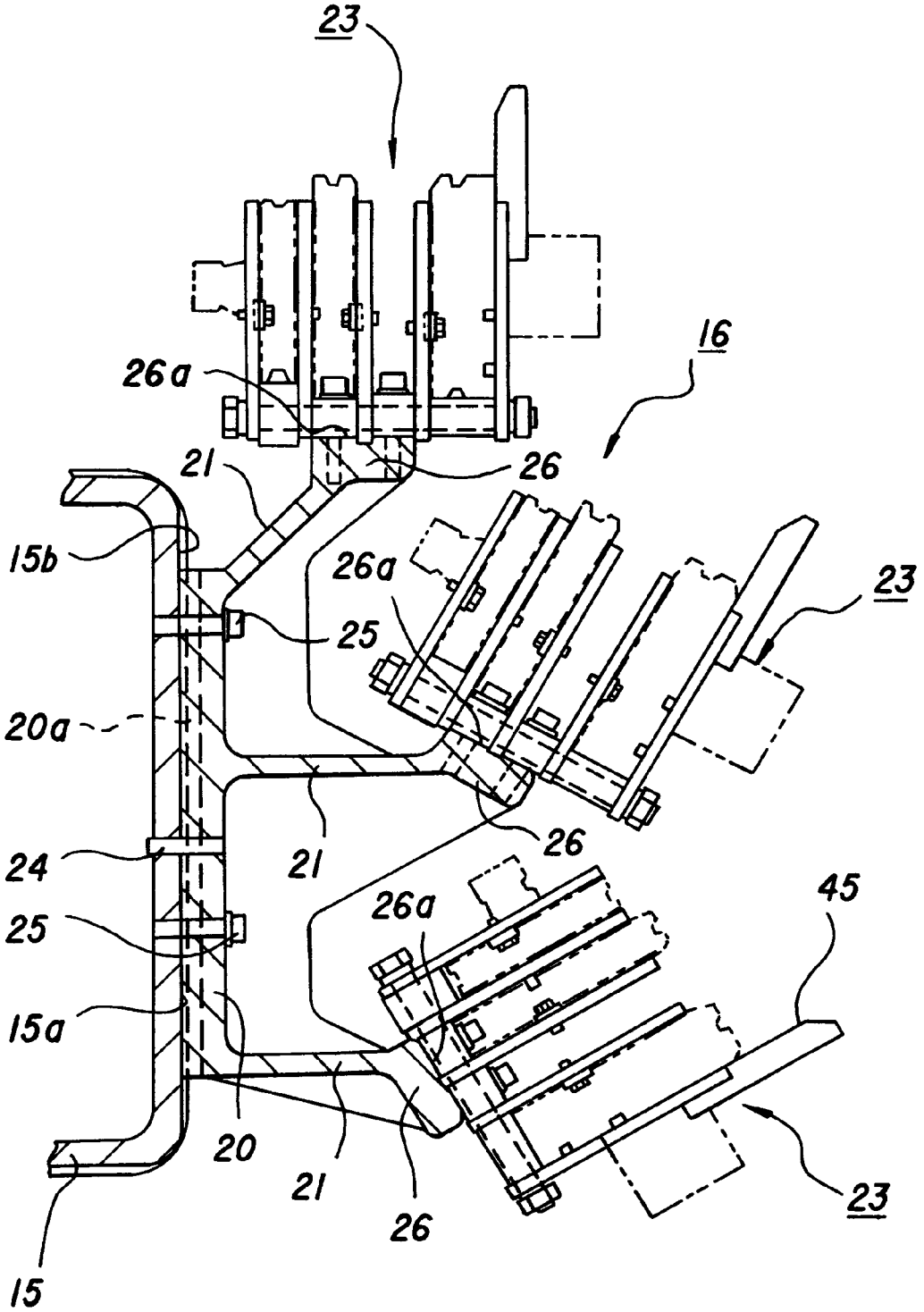

As shown in FIGS. 4 and 6, the support shaft 15 is hollow except its both ends and has a rectangular shape in cross-section. The support shaft 15 is provided with attaching parts 15*a* along its entire length outwardly and a number of tool set holding units 16 are removably attached to these attaching parts 15*a*. Each tool set holding unit 16 is composed of (i) a support body 22 comprising a rectangular base 20 and support brackets 21 which are forked from the base 20, projecting therefrom; and (ii) a plurality of tool set holders 23 (three holders in this embodiment) which are respectively supported at the respective lead ends of the support brackets 21. These tool set holders 23 are aligned at equal intervals in the circumferential direction of the support shaft 15. The base 20 is secured to a certain position of the support shaft 15 by positioning with a positioning pin 24 and by tightening with bolts 25, with an irregular portion 20*a* formed at the back of the base 20 being engaged with a groove 15*b* formed in the attaching part 15*a* of the support shaft 15. Each tool set holder 23 is attached to a bearing seat 26 which has a certain width and extends over the entire length of the lead end of the support bracket 21. This bearing seat 26 has a bearing surface 26*a* arranged at a specified angle. The projecting length of each support bracket 21 from the base 20 is so determined that all the tool set holders 23 take the same posture after being mounted in relation to the axis of the rotation of the support shaft 15.

Figure 7A:
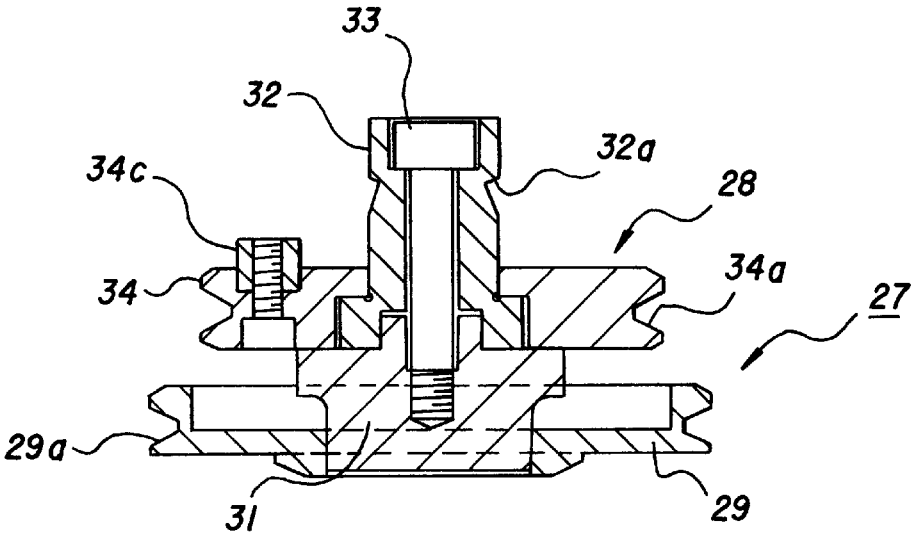
Figure 7B:
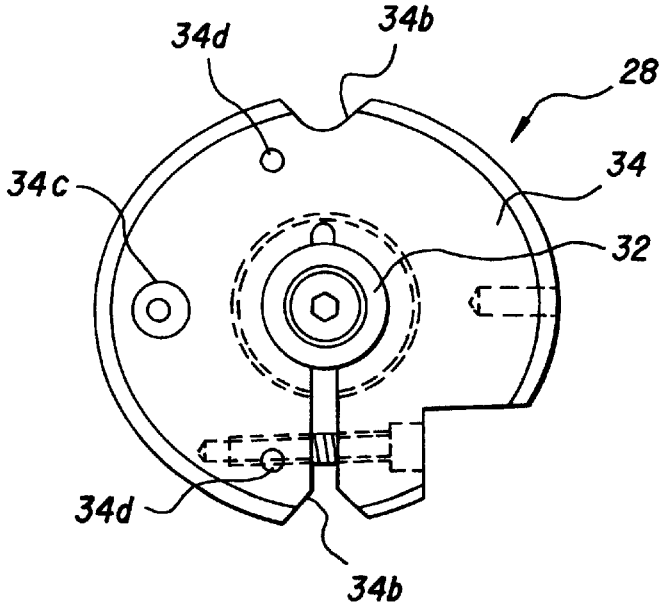
Figure 8A:
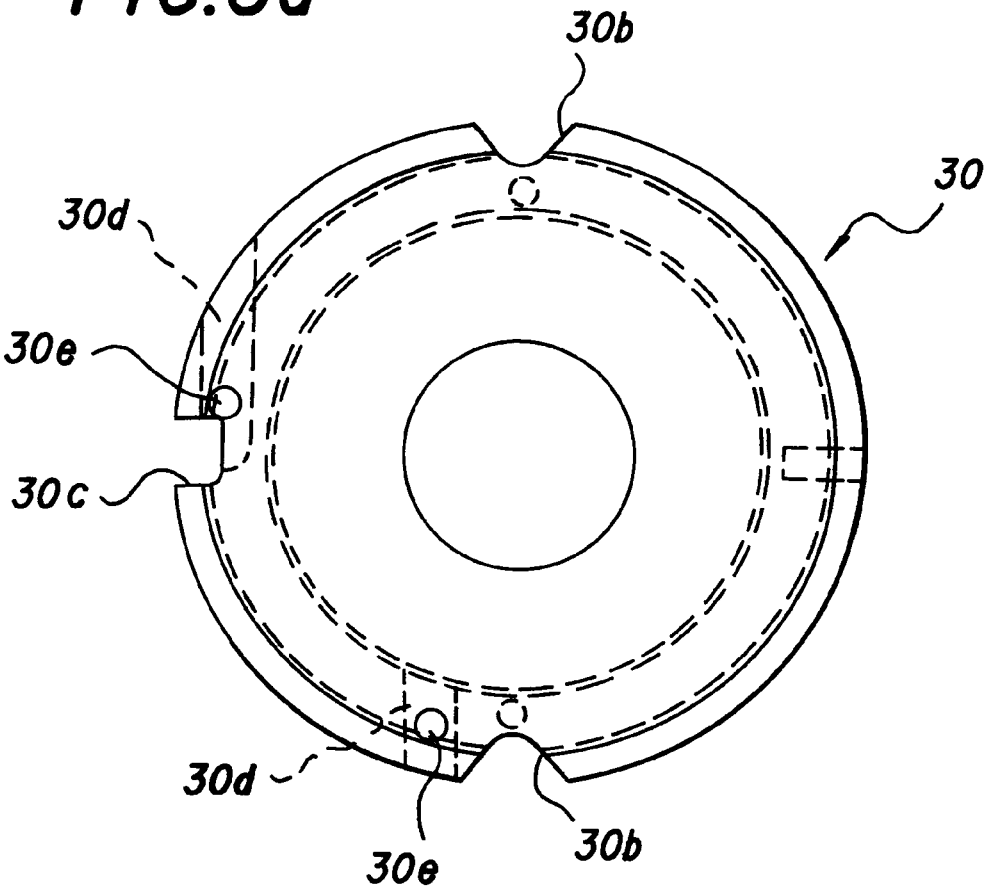
Figure 8B:
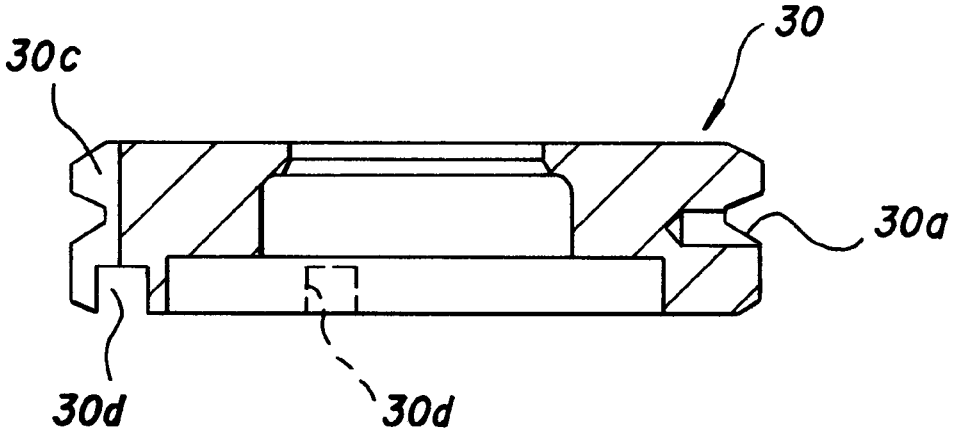
Figure 9A:
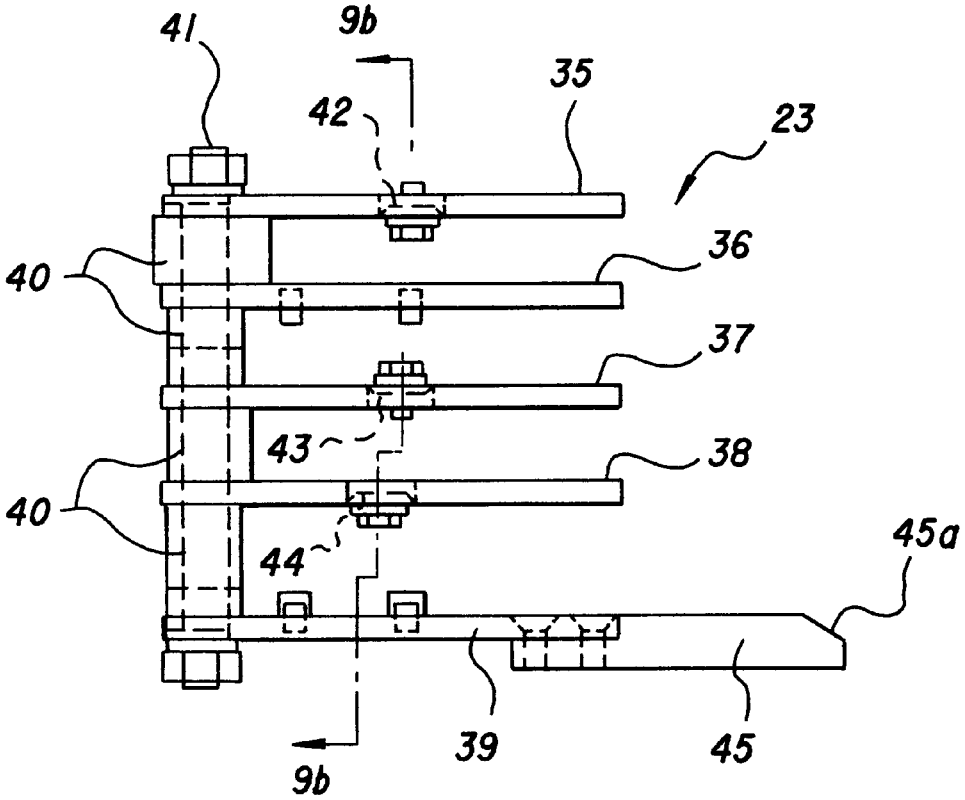
Figure 9B:
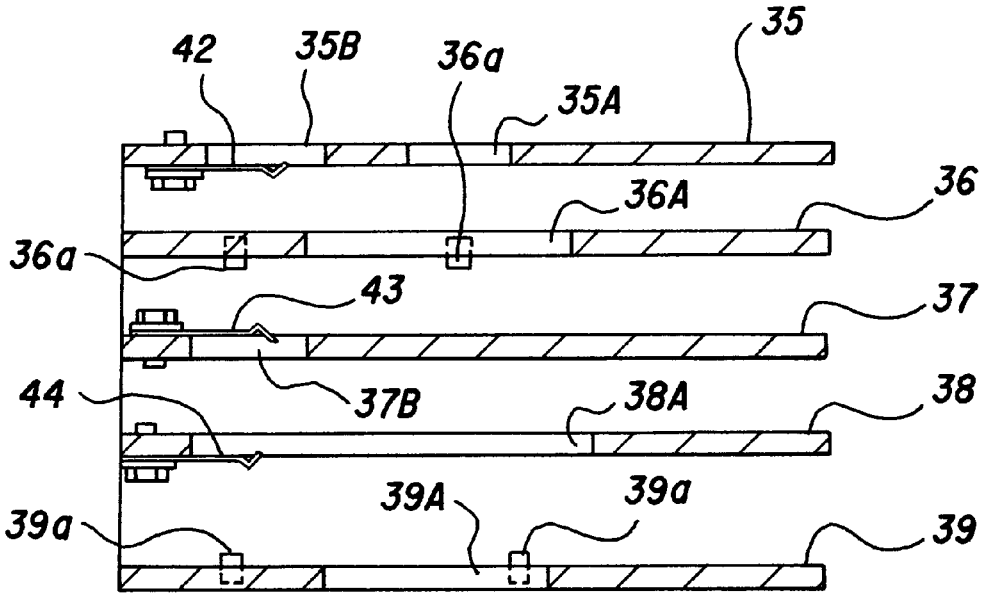

Reference is made to FIGS. 7 and 8 to describe a tool set 27 used in the punch press of the embodiment.

As shown in these figures, the tool set 27 is composed of (i) a punch 28; (ii) a stripper 29 incorporated in the punch 28; and (iii) a die 30. These three members grouped in a set are held by the tool set holding sections of the tool set holder 23.

The punch 28 has (i) a punch tip 31 of a desired shape and (ii) a clamp shank 32 having a certain dimension and shape in which the periphery is brought into holding engagement with the punching head 4*a* when the punch 28 is mounted on the head 4*a*. These members 31 and 32 are integrally coupled to each other with the help of a bolt 33. A retaining ring 34 for use in delivery is fixedly fitted on the base part of the clamp shank 32. An engagement groove 32*a* with a V-shaped cross-section runs throughout the periphery of the clamp shank 32. A retaining groove 34*a* with a V-shaped cross-section runs throughout the periphery of the retaining ring 34. At opposed positions, the retaining ring 34 is cut toward its axis in an opposite relation with each other to make a pair of V-shaped notches 34*b* on the plane which passes the axis of the retaining ring 34. On the upper surface of the retaining ring 34, a positioning pin 34*c* is provided at a position that is 90° shifted from the positions of the pair of V-shaped notches 34*b* and that is spaced from the center of the retaining ring 34 at a specified distance. This positioning pin 34*c* projects from the upper surface of the retaining ring 34 in parallel with the axis of the retaining ring 34. Countersunk engagement recesses 34*d* are also provided at suitable positions of the upper surface of the retaining ring 34 to prevent the punch 28 from shifting when it is accommodated in the tool set holding section. It should be noted that the external shape and attaching position of the positioning pin 34*c* as well as the shape and positions of the engagement recesses 34*d* are preferably standardized irrespective of the shape of the punch 28.

Generally, the stripper 29 is made from a material softer than the material of the punch 28. The stripper 29 is fitted on the periphery part of the punch 28 from the bottom such that the stripper 29 is supported to be vertically slidable. The stripper 29 also has, at its periphery, a V-shaped retaining groove 29*a* and a pair of V-shaped notches 29*b* (see FIG. 25) identical with the V-shaped notches 34*b* of the punch 28. The stripper 29 may have any shape and any structure according to the configuration of the punch 28. For example, the stripper 29 does not need to slide vertically but has a cushioning property, depending on the configuration of the punch 28. In cases where the stripper 29 is incorporated in a punch 28 having a small diameter, the V-shaped retaining groove 29*a* and the V-shaped notches 29*b* may be eliminated.

The die 30 includes, at its periphery, a V-shaped retaining groove 30*a* used for holding and a pair of V-shaped notches 30*b* similar to those of the punch 28. At the position on the periphery shifted from the positions of the V-shaped notches 30*b* by 90°, a notch 30*c* used for positioning is formed. At the underside of the die 30, there is provided at least one engagement groove 30*d* that runs in parallel with the V-shaped notches 30*b*. The die 30 has, at an appropriate position on the upper surface thereof, an engagement recess 30*e* formed identically with the engagement recess 34*d* of the punch 28.

Next, the detailed construction of the tool set holders 23 for holding the tool set 27 will be described with reference to FIGS. 4 to 6 and FIGS. 9 to 14.

Figure 5:
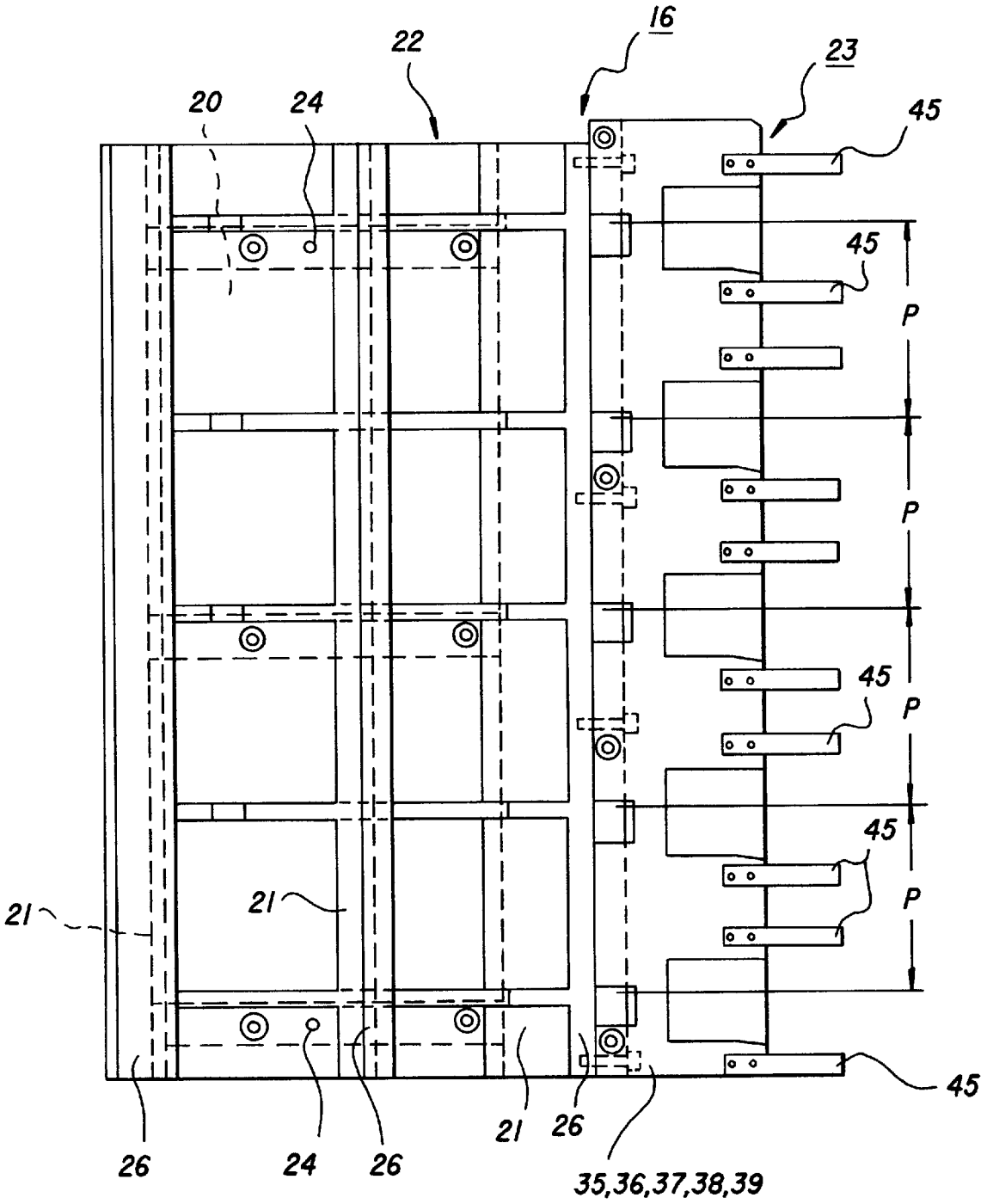

In each tool set holder 23, five tool set receiving members 35, 36, 37, 38, 39 are tightened and secured by means of a bolt 41 such that these tool set receiving members are spaced in parallel relationship with four spacers 40 interposed at their base ends so that the gaps between them correspond to the widths of the punch 28, stripper 29 and die 30, respectively. As shown in FIG. 5, each tool set holder 23 has five tool set holding sections for receiving and holding each member of the tool set 27, these sections being spaced at a predetermined pitch P. It should be noted that, according to this embodiment, three tool set holders 23 are aligned in a row in the circumferential direction of the support shaft 15 and five rows of tool set holders 23 are arranged in the axial direction of the support shaft 15, so that fifteen tool set holders 23 are included in each tool set holding unit 16, and that four tool set holding units 16 are disposed in a row around the support shaft 15, and five such rows are arranged in the axial direction of the support shaft 15, so that twenty tool set holding units 16 are provided in total. Accordingly, three hundred tool set holders 23 (i.e., 15×20=300) are provided in total in the tool set magazine 6. In other words, three hundred tool sets 27 each composed of the punch 28, stripper 29 and die 30 can be stored within the tool set magazine 6.

Figure 10A:
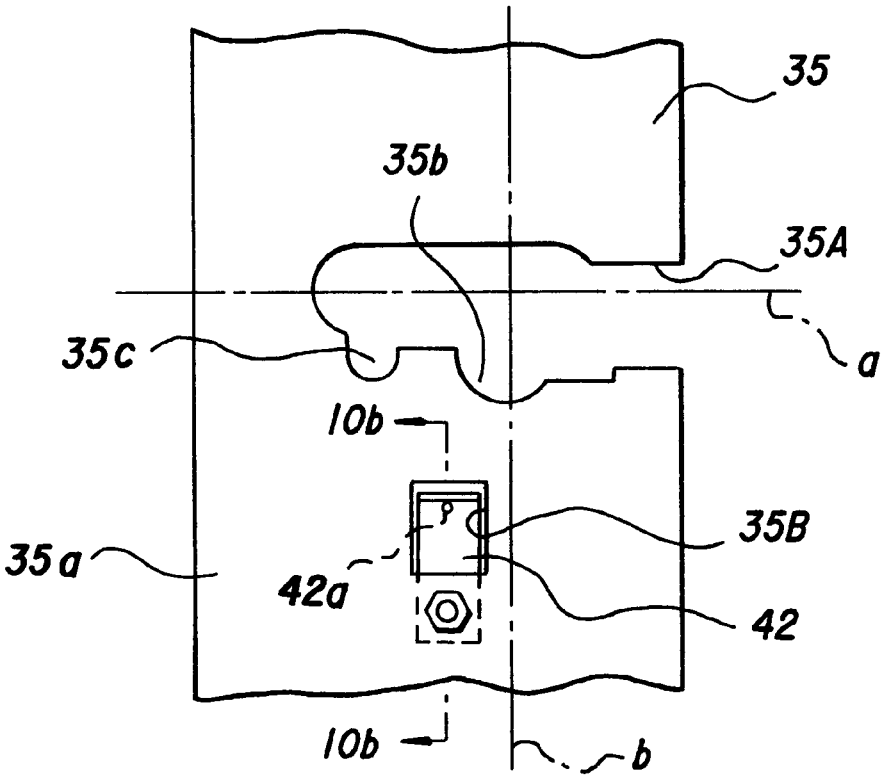
Figure 10B:
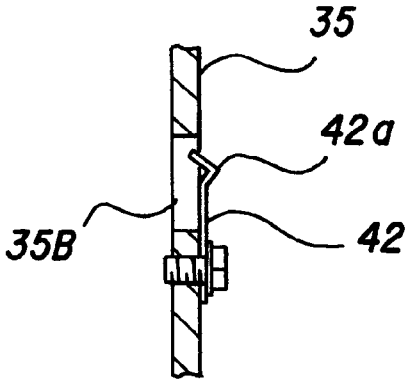

In each tool set holding section of the tool set holder 23, the punch 28 is held by the first tool set receiving member 35 and the second tool set receiving member 36. Therefore, the first tool set receiving member 35 is cut, from an open end side to a base end side 35*a*, to form a tool set receiving section 35A as shown in FIG. 10, the tool set receiving section 35A having such a width that the clamp shank 32 of the punch 28 can penetrate. In the section 35A, laterally oriented notches 35*b*, 35*c* are formed so as to correspond to the clamp shank 32 and positioning pin 34*c* of the punch 28. After the clamp shank 32 of the punch 28 has been received by the tool set receiving section 35A, the punch 28 is moved laterally in the axial direction of the support shaft 15 at a specified position, thereby bringing the clamp shank 32 and the positioning pin 34*c* into holding engagement with the notches 35*b*, 35*c* respectively. Apart from the tool set receiving section 35A, the tool set receiving member 35 has an engagement leaf spring 42 secured thereto with a bolt and this leaf spring 42 has a projection 42*a* which comes into engagement with the engagement recess 34*d* formed on the upper surface of the punch 28 thereby preventing the punch 28 from shifting laterally. At the attached position of the engagement leaf spring 42, a hole 35B is formed on the upper side of the engagement leaf spring 42. Note that chain line a of FIG. 10(*a*) indicates the center line of insertion of the punch 28 (tool set 27) (hereinafter referred to as "insertion center line a"), while chain line b indicates the center line of the lateral movement of the punch 28 (tool set 27) (hereinafter referred to as "lateral movement center line b") (The tool set receiving members 36, 37, 38, 39 also have similar center lines).

Figure 11:
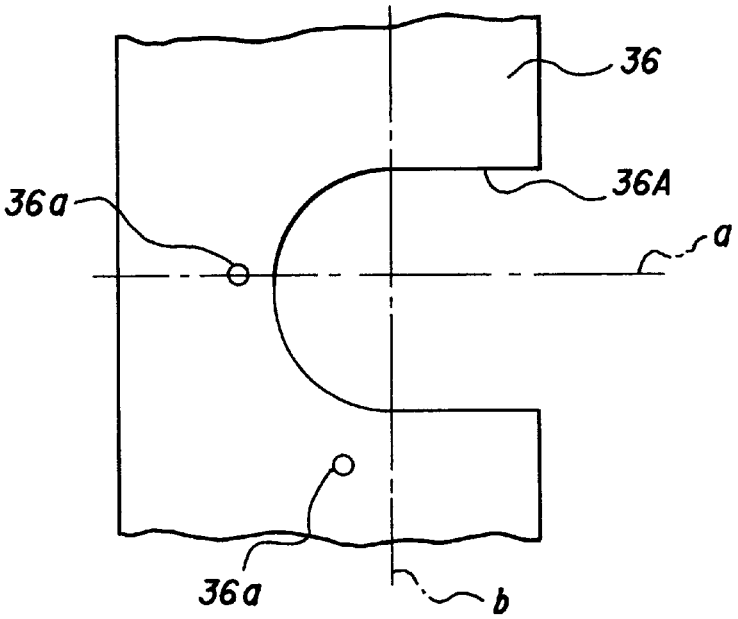

The second tool set receiving member 36 is cut in the same direction as the tool set receiving section 35A of the first tool set receiving member 35 to form a tool set receiving section 36A, as shown in FIG. 11. Projecting from the underside of the second tool set receiving member 36 are two stopper pins 36*a*. These stopper pins 36*a* come into engagement with a groove (not shown) formed on the top surface of the stripper 29 to prevent the it from falling.

Figure 12:
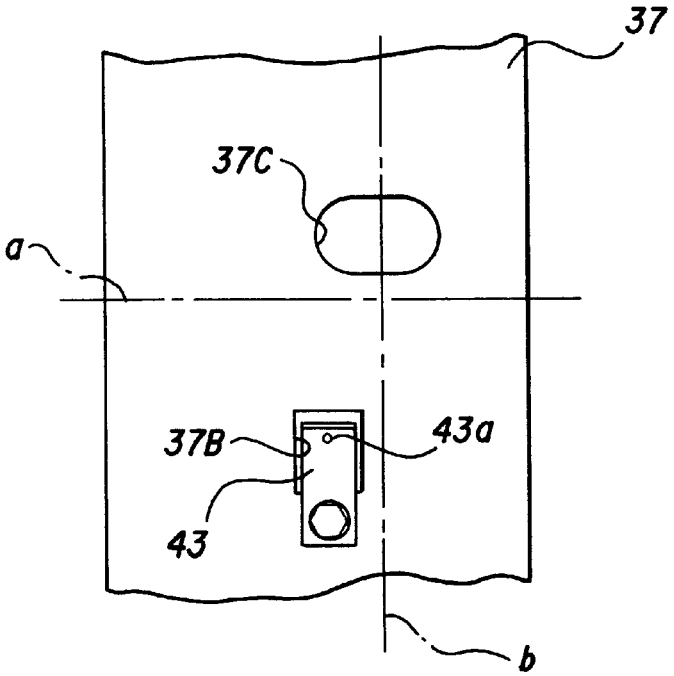

The third tool set receiving member 37 has, as shown in FIG. 12, an engagement leaf spring 43 with a projection 43*a* which has the same structure as that of the engagement leaf spring 42. This leaf spring 43 lies at a position somewhat distant from the lateral movement center line b in parallel with the center line b. The tool set receiving member 37 has a hole 37B formed at a lower position of the movable part of the engagement leaf spring 43. Reference numeral 37C designates another hole.

Figure 13:
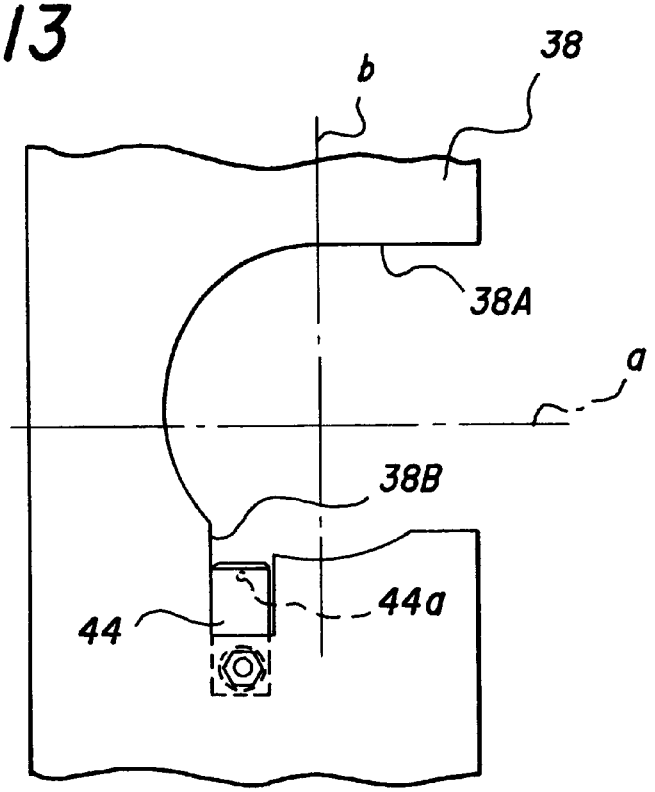

The forth tool set receiving member 38 is cut in the same direction as the tool set receiving sections 35A, 36A of the first and second tool set receiving members 35, 36 to form a tool set receiving section 38A, as shown in FIG. 13. Formed at the innermost part of the tool set receiving section 38A is a notch 38B which is formed in parallel with the lateral movement center line b. At the underside of the tool set receiving member 38, an engagement leaf spring 44 identical with the engagement leaf springs 42, 43 is disposed under the notch 38B and its movable part is directed toward the notch 38B. A projection 44*a* attached to the movable part of the leaf spring 44 comes into engagement with the engagement recess 30*e* formed on the top surface of the die 30, thereby preventing a fall of the die 30.

Figure 14:
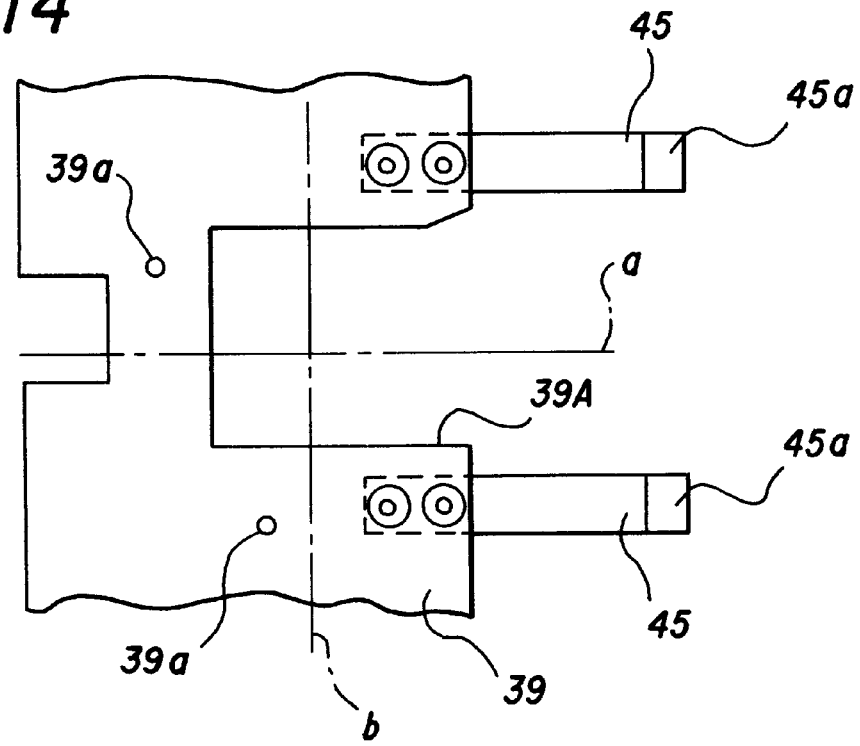

The fifth tool set receiving member 39 is cut in the same direction as the first, second and forth tool set receiving members 35, 36, 38 to form a rectangular tool set receiving section 39A, as shown in FIG. 14. The tool set receiving section 39A is designed to receive a projection attached to other tools (e.g., a tup unit) than the die 30. Formed on the top surface of the tool set receiving section 39 as to project therefrom are stopper pins 39*a* that come into engagement with a positioning groove 30*d* formed in the die 30 to prevent a fall of the die 30. A pair of fixed dogs 45 are disposed at both sides of the tool set receiving section 39A across its width. These dogs 45 project forwards in parallel with the insertion center line a. The top surfaces of the fixed dogs 45 are at the same level as the top surface of the tool set receiving member 39 and are inclined at the lead ends thereof to form inclined faces 45*a*.

The tool set holder 23 having the above-described construction is fabricated such that the insertion center lines a of the tool set holding sections in all the tool set receiving members 35, 36, 37, 38, 39 exist in the same vertical plane and such that the members of the tool set 27 are inserted and held in the predetermined assigned spaces formed between the tool set receiving members 35, 36, 37, 38 and 39. As clear from FIG. 4, the tool set holders 23 rotate about the axis of the support shaft 15 in such a manner that the axis of the tool set 27 inserted in the tool set holding sections makes a right angle with the axis of the support shaft 15 and such that the axis of the tool set 27 becomes vertical when each tool set holder 23 is at the delivery position (i.e., tool set loading/unloading position) S where the tool set 27 is delivered by the hand 13 of the ATC carriage 9. It should be noted that the delivery position S is located under the axis of the support shaft 15, being offset to the punching head 4*a*.

The loading and unloading direction of the tool set 27 at the delivery position S exists in a plane perpendicular to the support shaft 15 and perpendicular to the axis of the tool set 27.

In the above arrangement, the magazine indexing and actuating means 19 indexes the support shaft 15 of the tool set magazine 6 to obtain a rotation angle and rotates the support shaft 15 through the rotation angle, while the ATC carriage 9 of the tool set delivery system 7 moves along the rail 8 toward a specified position to place the carrier 12 and hand 13 at specified positions, so that a desired tool set 27 can be loaded or unloaded.

Figure 15:
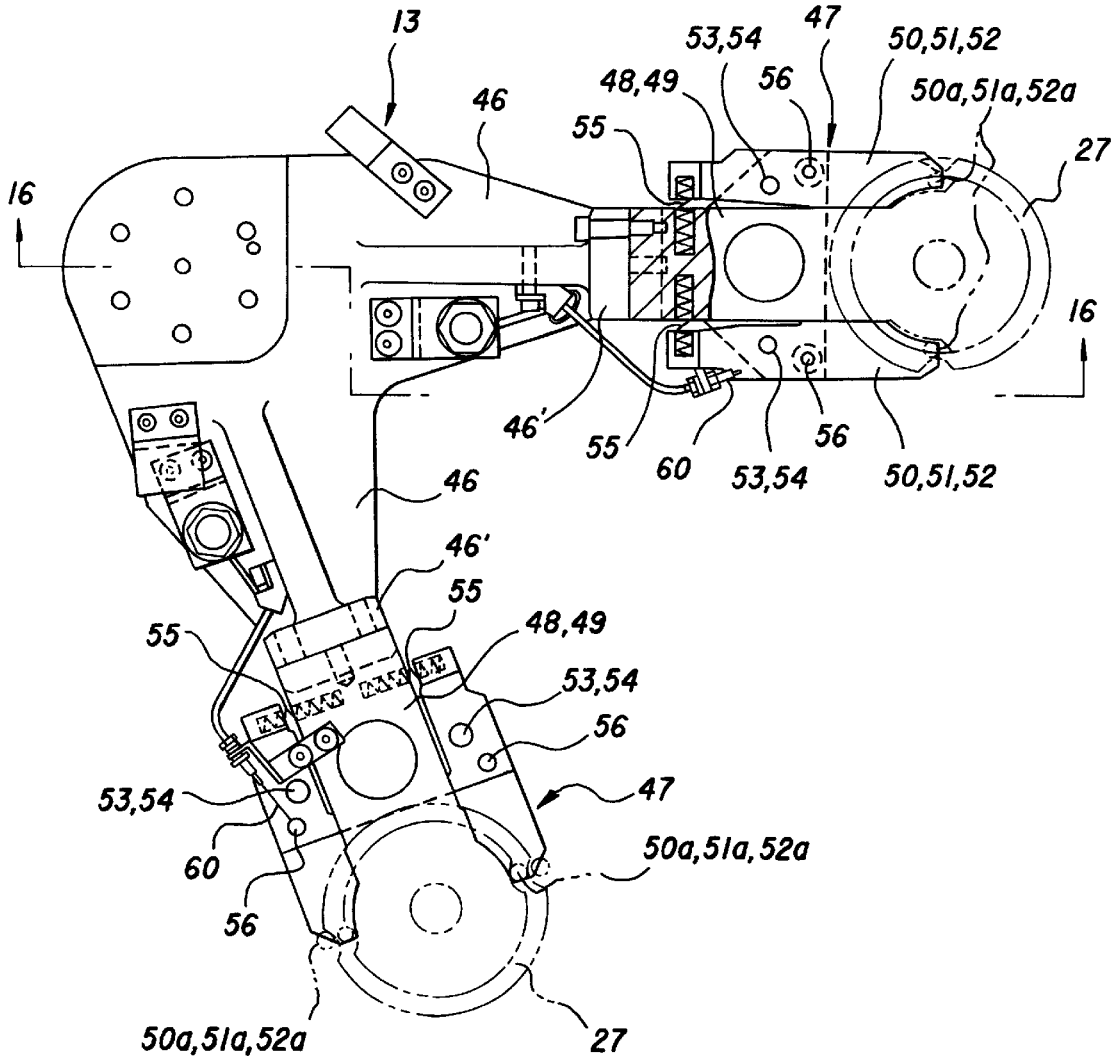
Figure 16:
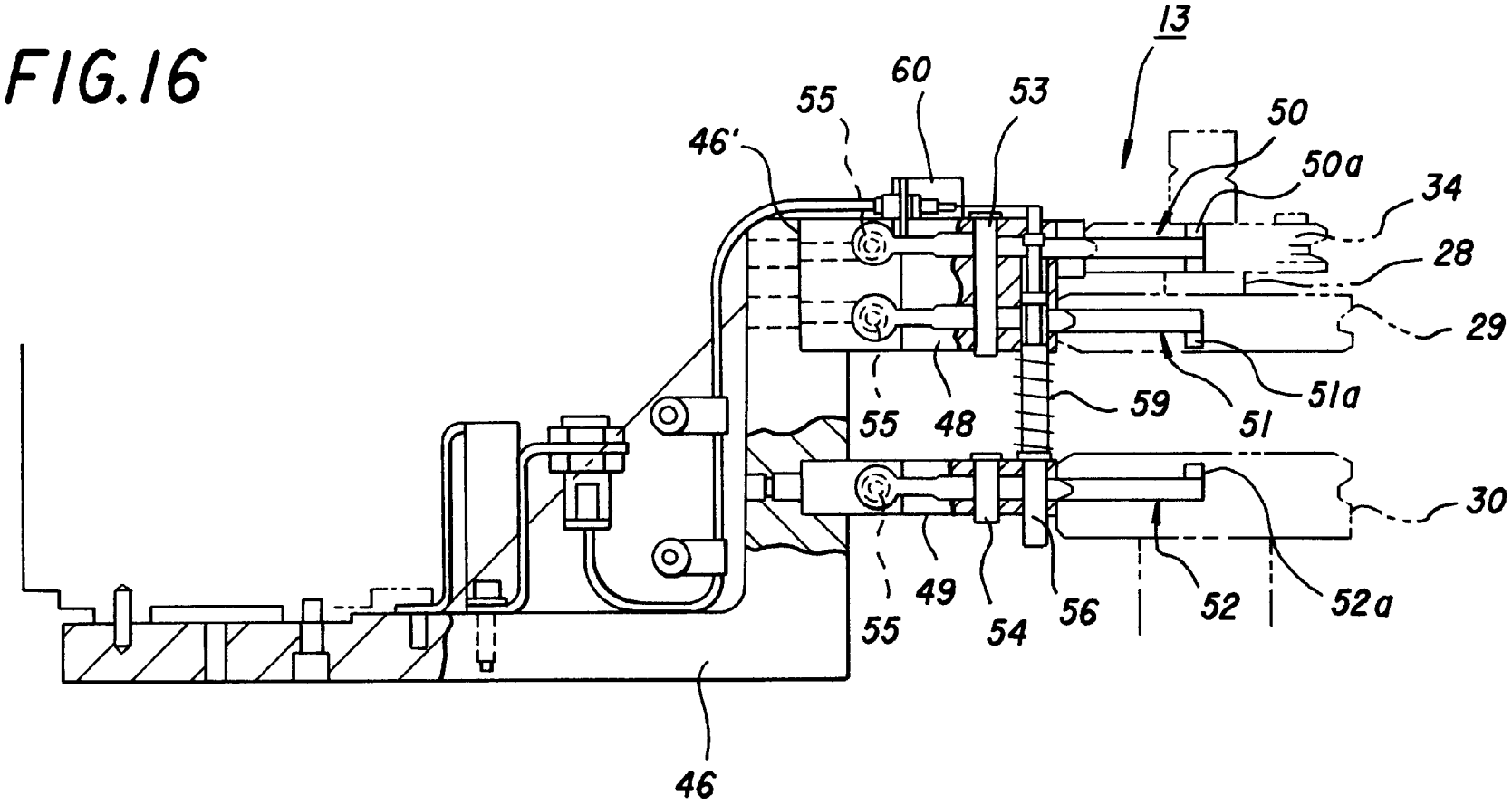

FIGS. 15 and 16 show the hand 13 of the tool set delivery system 7.

As mentioned above, the hand 13 can horizontally turn through a specified angle relative to the carrier 12 (see FIG. 4) and can be lifted and lowered between the level at which the tool set 27 is loaded in unloaded from the tool set magazine 6 and the level at which the tool set 27 is mounted on or dismounted from the punching head 4*a* and mount table 4*b* of the work center 4. The hand 13 comprises two arms 46 which project from a base part (this part is the center of rotation) such that these two arms 46 together take a V-shape in their plan view. The lead end of each arm 46 has a gripping mechanism 47 for retaining the tool set 27 in an assembled condition. The angle between the two arms 46 is an acute angle, and more preferably about 70°.

Figure 17A:
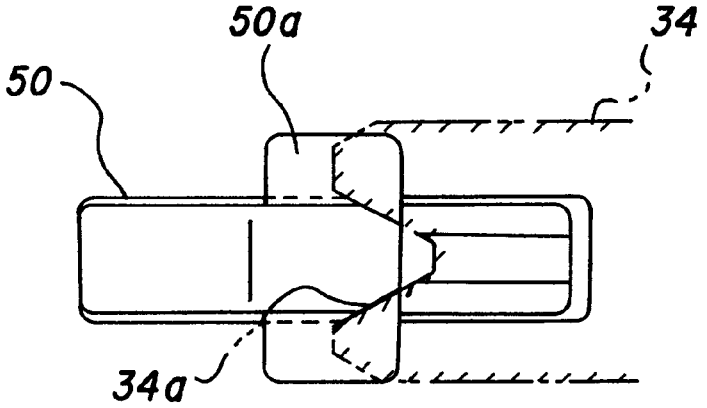
Figure 17B:
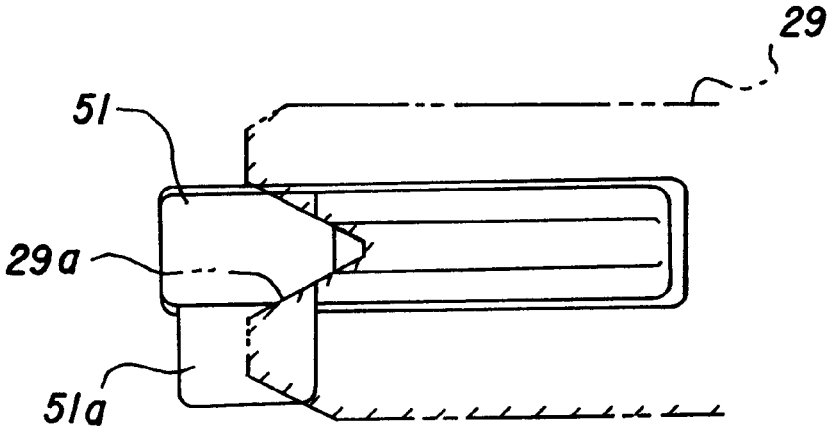
Figure 17C:
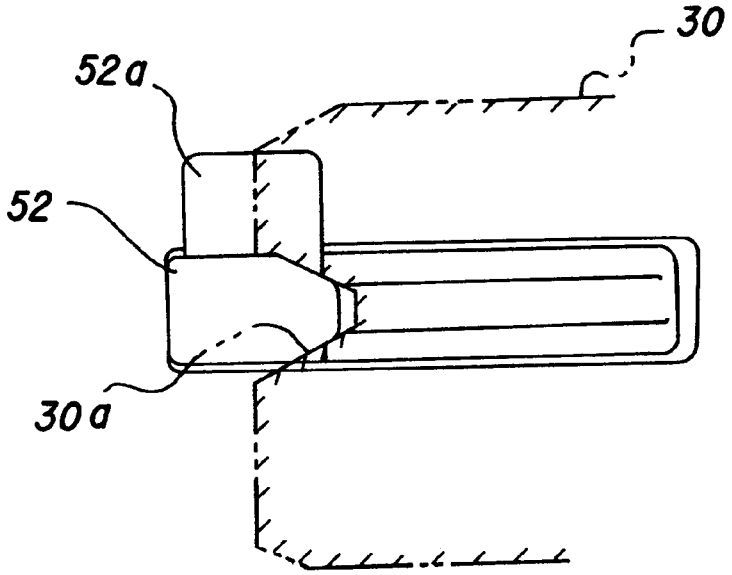

In each of the gripping mechanisms 47, an upper bracket 48 and a lower bracket 49 are fixedly attached to a mounting seat 46' located at the lead end of the arm 46. Attached to the upper bracket 48 are a pair of gripping pierces 50 for the punch 28 and a pair of gripping pieces 51 for the stripper 29. Attached to the lower bracket 49 is a pair of gripping pieces 52 for the die 30. These gripping piece pairs 50, 51, 52 are respectively symmetrically disposed and their base parts are pivotally supported to the brackets 48 or 49 with the help of pins 53, 54. Coil springs 55 inserted in the trail ends of the gripping piece pairs 50, 51, 52 are energized to allow engagement claw pairs 50*a*, 51*a*, 52*a* provided at the leads ends of the gripping piece pairs 50, 51, 52 to come into engagement with the V-shaped notches 34*b* of the retaining ring 34 of the punch 28, the V-shaped notches 29*b* formed on the periphery of the stripper 29, and the V-shaped notches 30*b* formed on the periphery of the die 30, respectively. The engagement claws 50*a*, 51*a*, 52*a* are respectively made in the form of a pin parallel with the axis of holding (i.e., the axis of the tool set 27) so that they can engage with the V-shaped notches 34*b* of the retaining ring 34 of the punch 28, the V-shaped notches 29*b* of the stripper 29, and the V-shaped notches 30*b* of the die 30, respectively (see FIG. 17).

The lead ends of the gripping piece pairs 50, 51, 52 are tapered down with chamfered upper and lower surfaces so as to be fitted in the V-shaped retaining groove 34*a* of the retaining ring 34 of the punch 28, the retaining groove 29*a* of the stripper 29 and the retaining groove 30*a* of the die 30, respectively. The lateral movements of the gripping piece pairs 50, 51, 52 are restricted by lock pins 56 each of which is located somewhat distantly from the center of pivot in the respective main part of the gripping pieces 50, 51, 52. When the lock pins 56 are released, the lead ends of the gripping piece pairs 50, 51, 52 where the engagement claws 50*a*, 51*a*, 52*a* are attached move against the energizing forces of the coil springs 55 to open.

Figure 18:
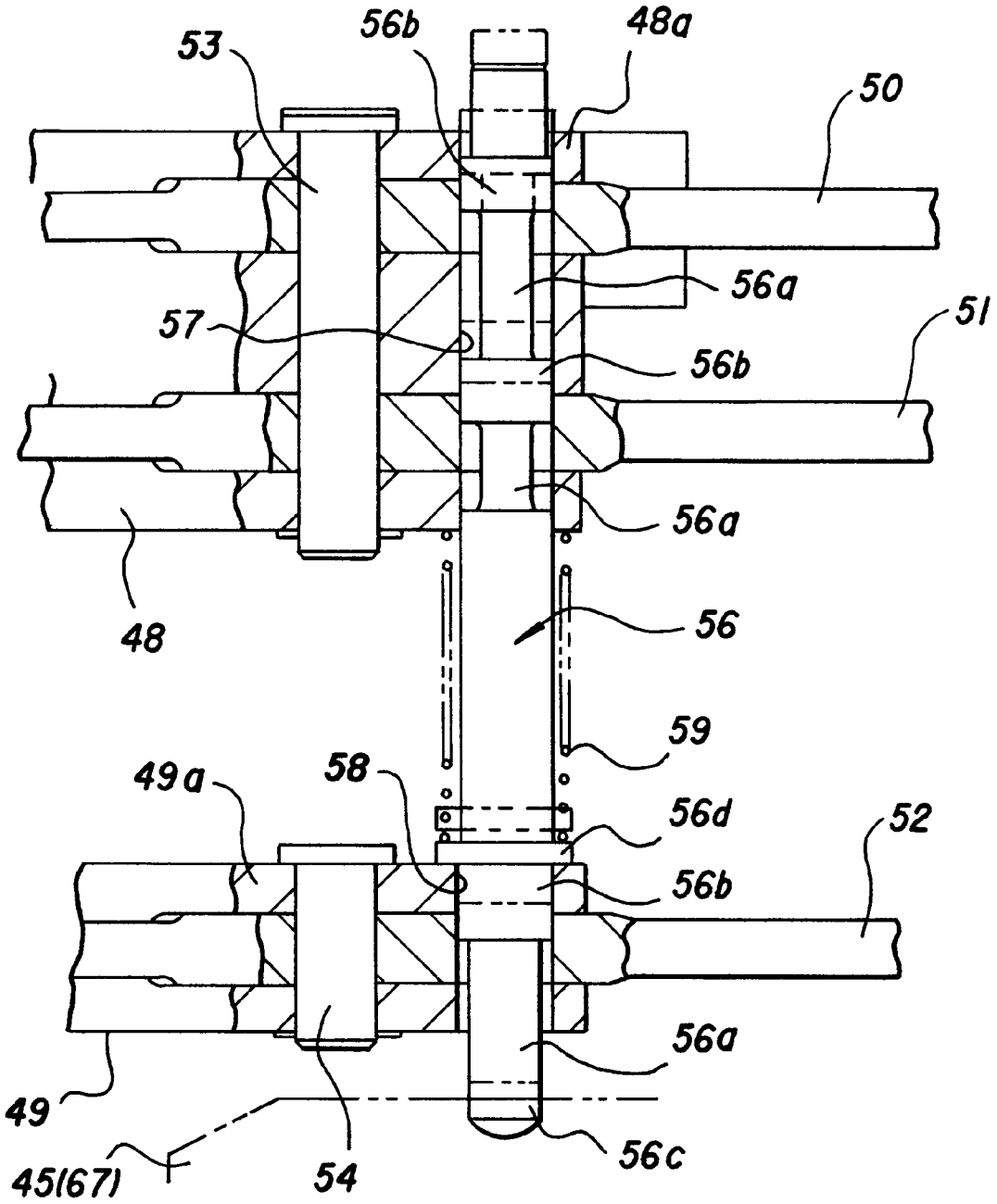

As shown in FIG. 18, each of the lock pins 56 is arranged so as to be slidable in a vertical direction, penetrating vertically running, lock-pin penetration holes 57, 58 which are formed in a wing 48*a* of the upper bracket 48 and a wing 49*a* of the lower bracket 49, respectively. The lock pin 56 includes small diameter parts 56*a* and large diameter parts 56*b*, these parts having specified lengths and being positioned in relation to the gripping pieces 50, 51, 52 in the lock-pin penetration holes 57, 58. The lock pin 56 is energized downwards (i.e., locking direction) all the time by means of a coil spring 59 inserted between the upper and lower wings 48*a* and 49*a*. The lower end 56*c* of the lock pin 56 protrudes downward from the underside of the lower bracket 49.

When a brim 56*d* projecting from the lock pin 56 comes in abutment with the top surface of the wing 49*a* of the lower bracket 49 owing to the energizing force of the coil spring 59, the large diameter parts 56*b* come to the positions (indicated by solid lines in FIG. 18) in the lock-pin penetration holes 57, 58, these positions corresponding to the gripping pieces 50, 51, 52, so that the gripping pieces 50, 51, 52 are locked. For unlocking, the lower end 56*c* of the lock pin 56 in the above locking condition is pushed upward by the fixed dogs 45 provided at the lowest tool set receiving member 39 of the tool set holder 23 or by fixed dogs 67 (described later) provided at the work center 4. The lock pin 56 thus moves up against the energizing force of the coil spring 59 and slides such that the small diameter parts 56*a* moves to the positions (indicated by chain lines in FIG. 18) in the lock-pin penetration holes 57, 58, the positions corresponding to the gripping pieces 50, 51, 52. As a result, the gripping pieces 50, 51, 52 are released from their locked condition. Note that reference numeral 60 in FIGS. 15 and 16 designates a lock sensor that senses the locking condition or unlocking condition of the lock pins 56 thereby checking the held condition of the tool set 27.

Figure 19:
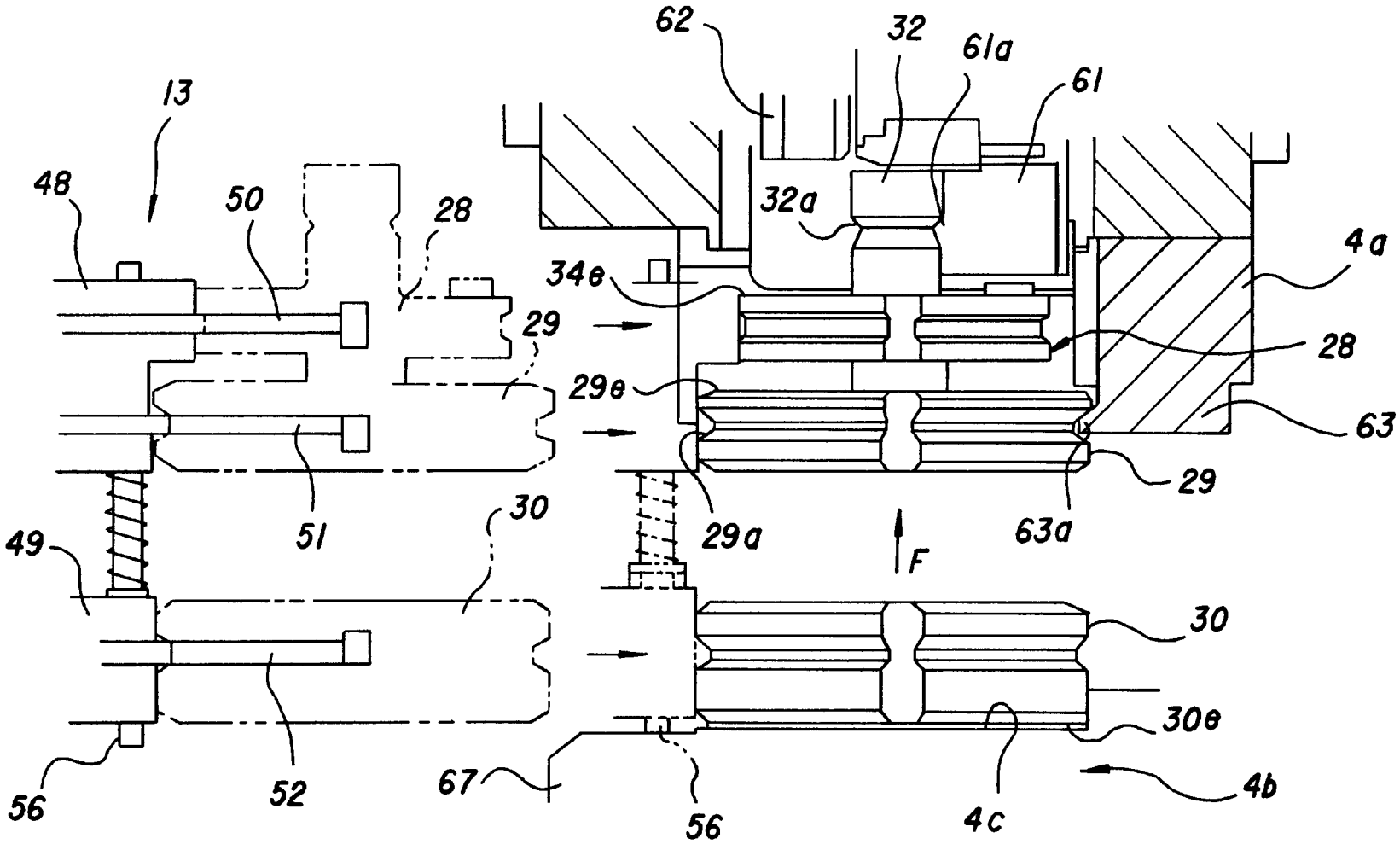
Figure 20:
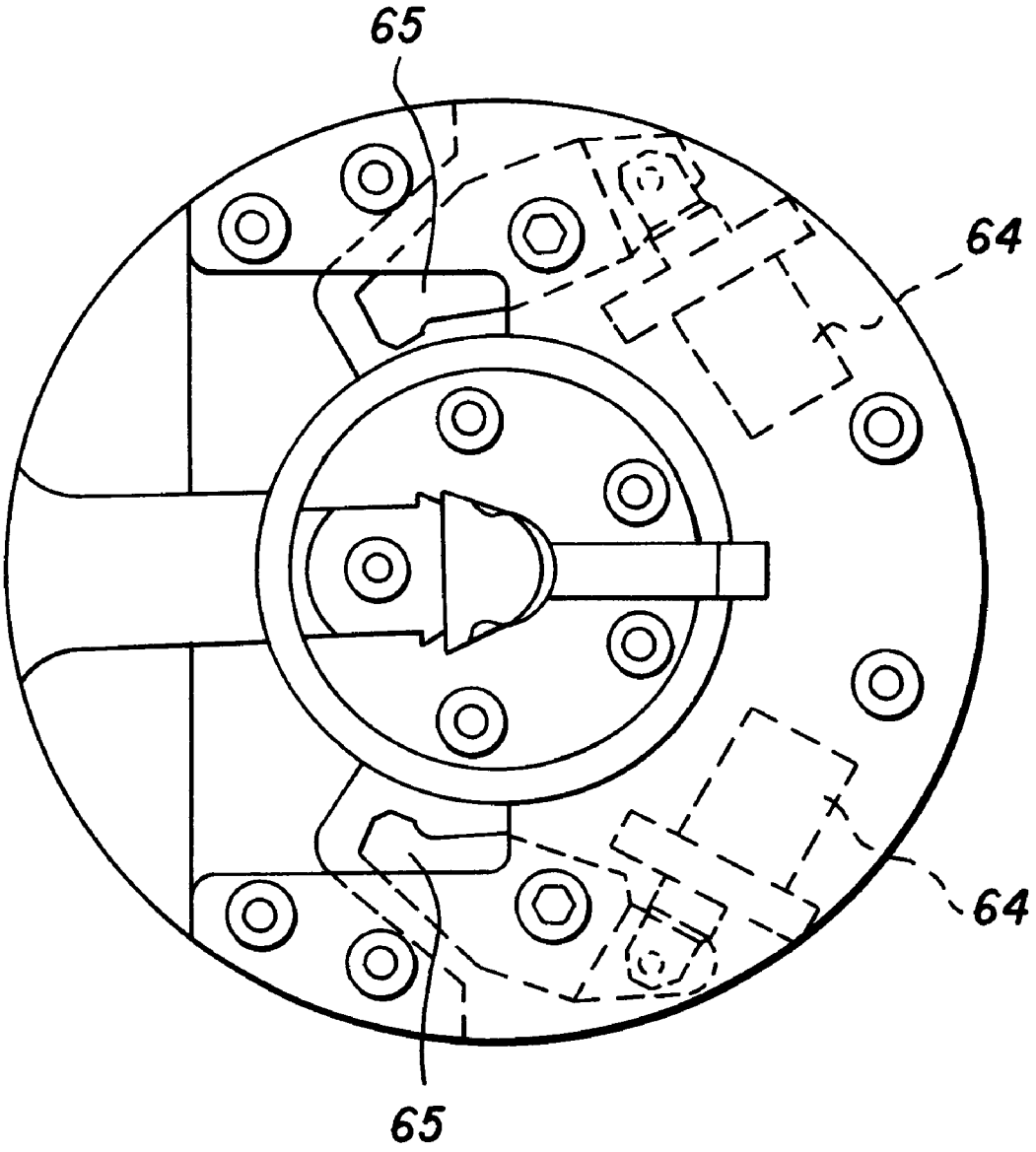

As shown in FIG. 19, the punching head 4*a* on which the punch 28, stripper 29 and die 30 retained by the hand 13 are to be mounted has (i) an engaging member 61 having a projection 61*a* to be engaged with the V-shaped engagement groove 32*a* of the clamp shank 32; (ii) a punch clamp claw 62 that is lowered by the operation of a punch clamp cylinder (not shown) to hold the clamp shank 32 in cooperation with the engaging member 61; and (iii) an engaging member 63 having a projection 63*a* to be engaged with the V-shaped retaining groove 29*a* of the stripper 29. The punching head 4*a* also has, as shown in FIG. 20, two stripper clamp cylinders 64 and two stripper clamp claws 65 which are operationally coupled to the stripper clamp cylinders 64, respectively. These stripper clamp claws 65 retain the peripheral of the stripper 29 at two positions. Similarly, the mount table 4*b* provided on the fixed bed 2, on which the die 30 is to be mounted, has die clamp cylinders and die clamp claws (both are not shown) which are constructed similarly to the stripper clamp cylinders 64 and the stripper clamp claws 65. With these die clamp cylinders and die clamp claws, the die 30 is positioned at a specified position.

Figure 21A:
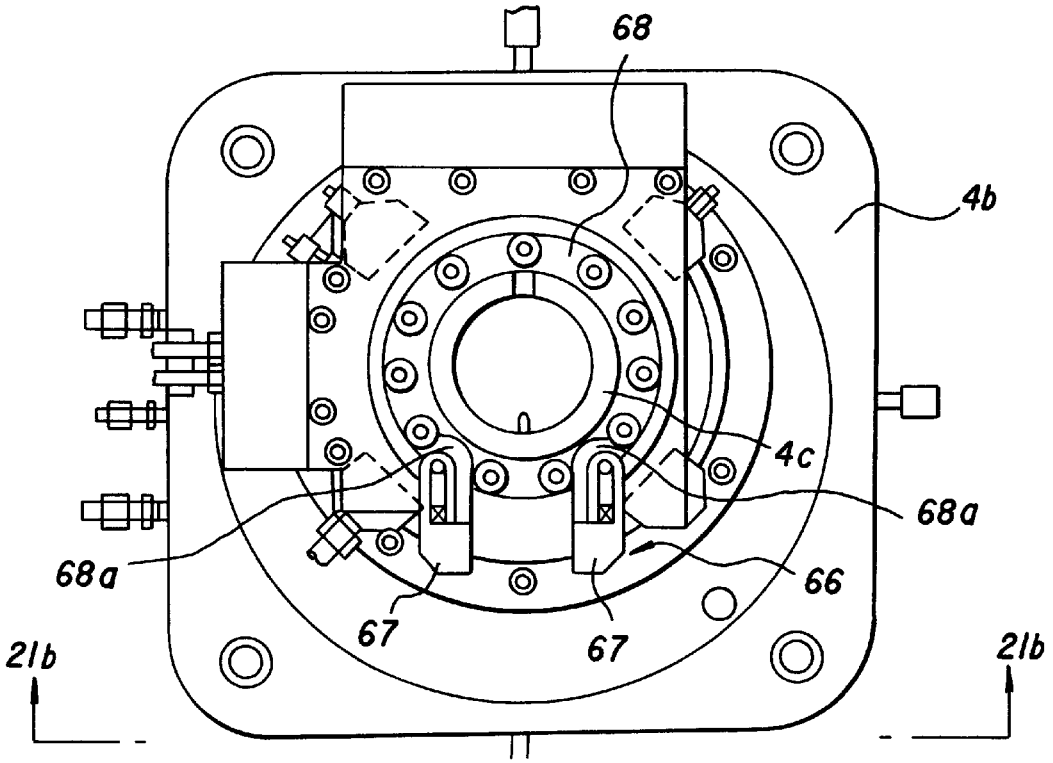
Figure 21B:
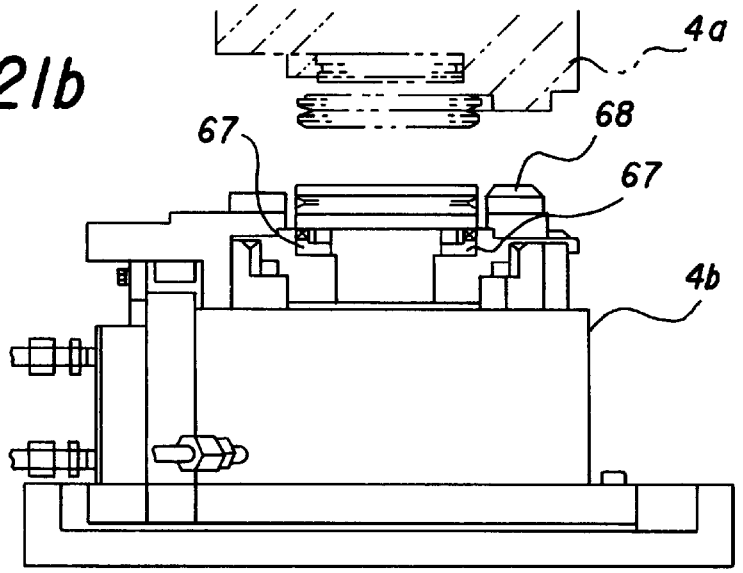

Referring to FIG. 21, the mount table 4*b* is provided with an unlocking means 66 for releasing the locking force of the lock pins 56 of the hand 13. The unlocking means 66 operates the fixed dogs 67 incorporated in the mount table 4*b* such that the fixed dogs 67 push up the lock pins 56 in the same manner as the fixed dogs 45 of the tool set holder 23 to release the gripping pieces 50, 51, 52 from their locked condition.

Now there will be explained the operation for delivering the tool set 27 between the tool set magazine 6 and the work center 4 by means of the tool set delivery system 7 of the above-described structure.

Figure 22:
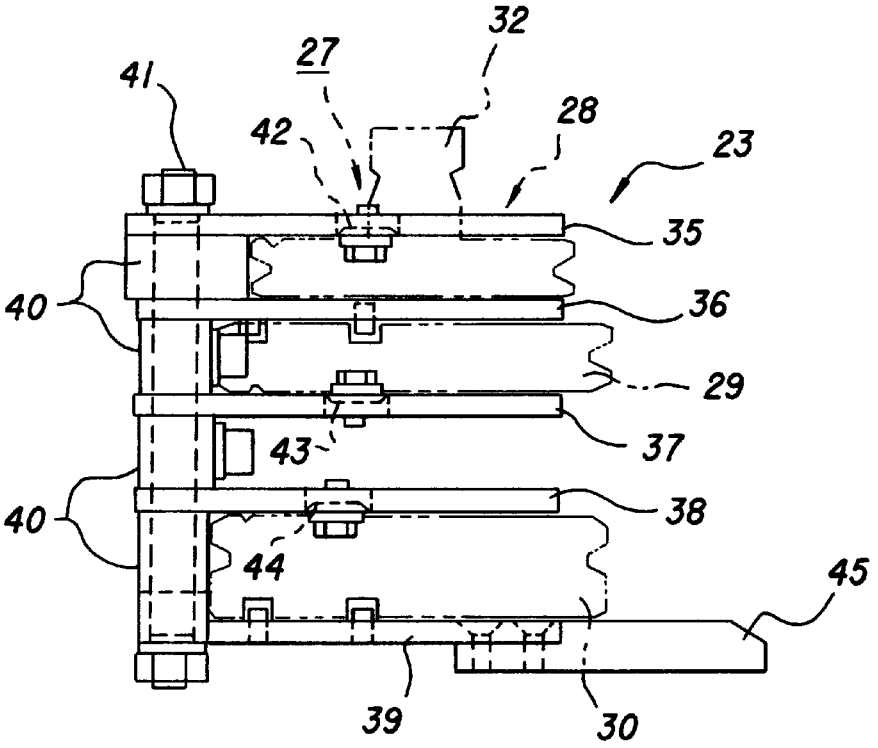

As shown in FIG. 22, the punch 28, stripper 29 and die 30 are held by the tool set receiving members 35, 36, 37, 38, 39 and accommodated in the assembled condition in the tool set holding sections of the tool set holder 23.

Figure 23:
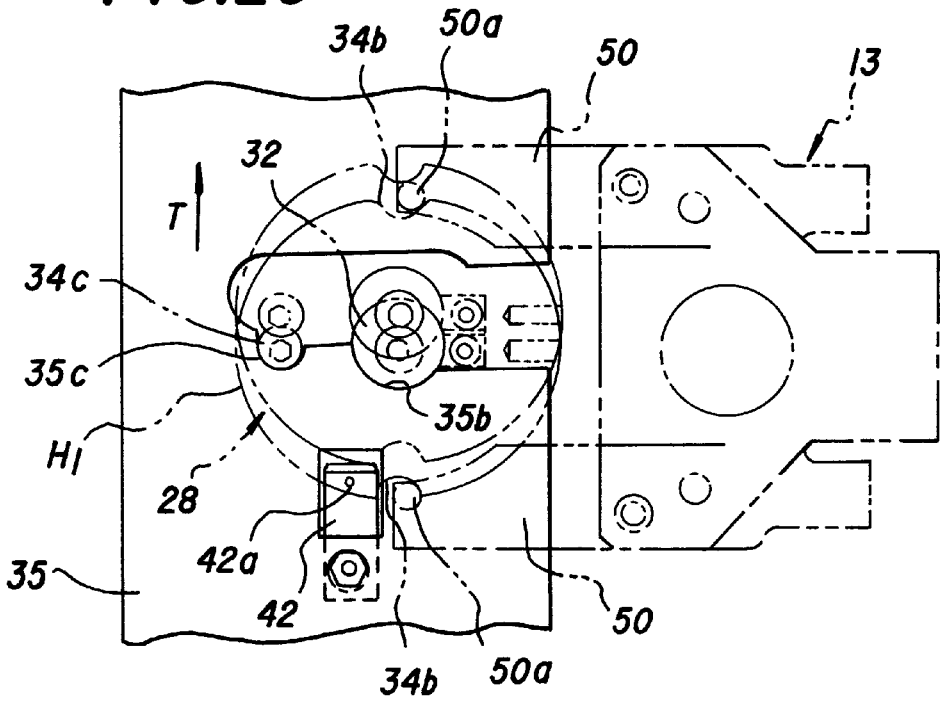
Figure 24:
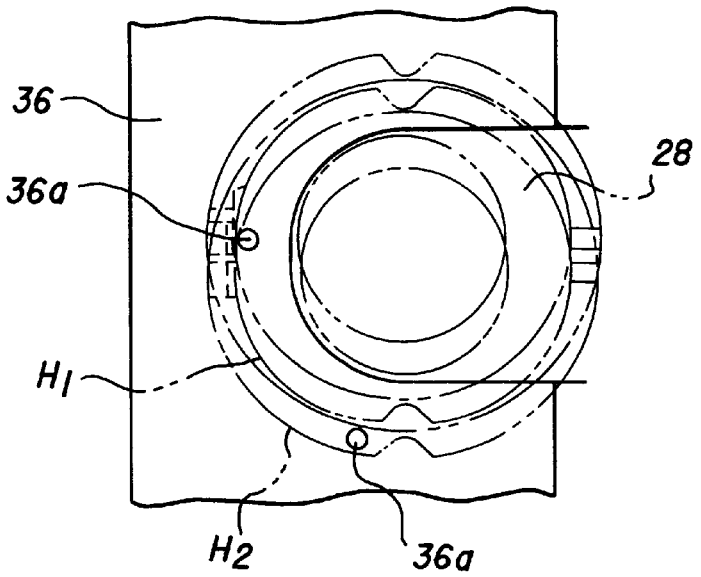

When the tool set 27 is accommodated in the tool set holder 23, the punch 28 is supported by the first tool set receiving member 35 and the second tool set receiving member 36 as indicated by chain line $H_1$ of FIGS. 23 and 24. In this condition, the clamp shank 32, the positioning pin 34*c* and the projection 42*a* of the engagement leaf spring 42 engage with the notches 35*b*, 35*c* and the recess 34*d* of the retaining ring 34, respectively.

Figure 25:
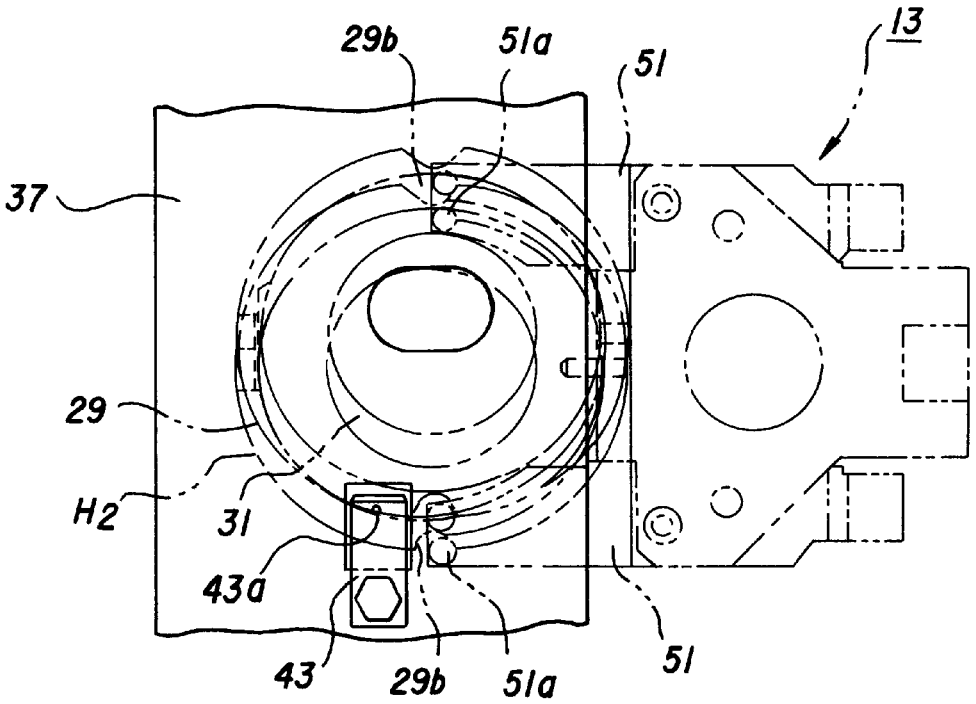

The stripper 29 is supported by the second tool set receiving member 36 and the third tool set receiving member 37 as indicated by chain line $H_2$ of FIGS. 24 and 25. In this condition, the stopper pins 36*a* engage with the groove formed on the top surface of the stripper 29 while the projection 43*a* of the engagement leaf spring 43 engages with a recess (not shown) formed in the stripper 29.

Figure 26:
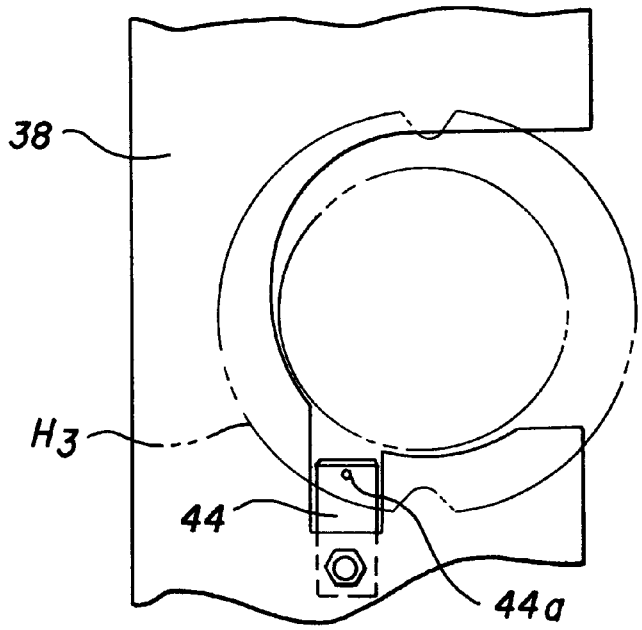
Figure 27:
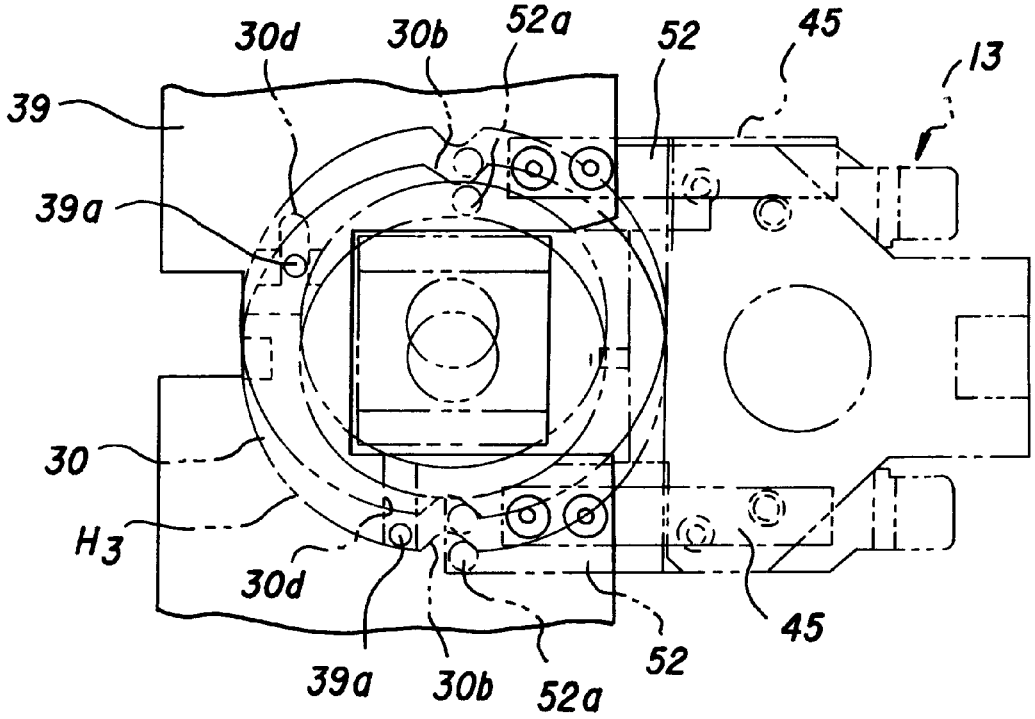

The die 30 is supported in the condition indicated by chain line $H_3$ of FIGS. 26 and 27 by means of the forth and fifth tool set receiving members 38, 39. In this condition, the stopper pins 39*a* engage with the positioning grooves 30*d* of the die 30 while the projection 44*a* of the engagement leaf spring 44 engages with the recess 30*e* of the die 30.

Thus, even when the tool set magazine 6 is rotated about the support shaft 15 to take out the tool set 27 therefrom, the tool set 27 will be securely held, without falling down from the tool set holding sections of the tool set holder 23.

For tool set replacement, the movable table 3 is retracted in the direction of the Y-axis to a predetermined position so that the hand 13 can perform a horizontal turn. This retraction is carried out for fear of the interference by the hand 13. Specifically, since the tool set replacement is performed on the assembled condition grouped in a set and the die 30 is mounted on the mount table 4*b* that is lower than the pass line for the workpiece, the hand 13 would interfere with the movable table 3 or the workpiece when the hand 13 is lowered to the tool set delivery position on the side of the work center 4.

After the address number of a desired tool set 27 has been selected according to the program for operating the control mechanism, a command is sent to the magazine indexing and actuating means 19 to rotate the support shaft 15 through a specified angle so that the desired tool set 27 comes to the tool set delivery position (i.e., tool set loading/unloading position) S shown in FIG. 4. After the desired tool set 27 has reached the position S, the rotation of the support shaft 15 is stopped.

While the tool set magazine 6 is indexed and rotated as mentioned above, the control unit releases a movement command to the tool set delivery system 7 from the control mechanism so that the ATC carriage 9 is moved along the rail 8 to the position corresponding to the address of the desired tool set 27 in the tool set magazine 6 and the carrier 12 is lifted or lowered. Meanwhile, the hand 13 turns, moving either of its gripping mechanisms 47 to the position opposite to the tool set delivery position S.

Thereafter, the gripping mechanism 47 moves forward to the tool set holder 23 to put the gripping pieces 50, 51, 52 for the punch 28, stripper 29 and die 30 in the tool set holding sections. The lower ends 56*c* of the lock pins 56 of the gripping mechanism 47 in the hand 13 are brought into contact with the top surfaces of the fixed dogs 45 of the tool set receiving member 39 in the tool set holder 23, whereby the lock pins 56 are pushed up against the energizing forces of the coil springs 59. This allows the respective small diameter parts 56*a* formed in the middle parts of the lock pins 56 to be placed at the positions in the lock-pin penetration holes 57, 58 of the gripping pieces 50, 51, 52, the positions corresponding to the gripping pieces 50, 51, 52. As a result, the gripping pieces 50, 51, 52 become free within the respective gaps between the small diameter parts 56*a* of the lock pins 56 and the lock-pin penetration holes 57, 58, so that the engagement claws 50*a*, 51*a*, 52*a* formed at the lead ends of the gripping pieces 50, 51, 52 become laterally movable into the V-shaped retaining grooves 34*a*, 29*a*, 30*a* to hold the punch 28, stripper 29 and die 30, respectively.

After the hand 13 has reached the foremost position, regarding the punch 28, the engagement claws 50*a* of the gripping pieces 50 engage with the V-shaped notches 34*b* of the retaining ring 34 as shown in FIG. 23. Similarly, regarding the stripper 29, the engagement claws 51*a* of the gripping pieces 51 engage with the V-shaped notches 29*b* as shown in FIG. 25. Regarding the die 30, the engagement claws 52*a* of the gripping pieces 52 engage with the V-shaped notches 30*b* formed on the periphery of the die 30 as shown in FIG. 27. In this condition, the gripping pieces 50, 51, 52 are once moved laterally in the axial direction (i.e., the direction indicated by arrow T of FIG. 23) of the support shaft 15 by a specified amount and retracted after releasing the engagement between the positioning pins and the notches. This allows the lock pins 56 to be separated from the top surfaces of the fixed dogs 45, thereby pulling back the gripping pieces 50, 51, 52 immediately by the energizing forces of the coil springs 55 so that the gripping pieces 50, 51, 52 are locked while holding the tool set 27. Thus, the tool set 27 which has been taken from the tool set magazine 6 by the hand 13 becomes movable in a securely held condition.

Once the tool set 27 thus held by the hand 13 has been retracted from the tool set delivery position S to the traveling position, it is lowered to a predetermined level and then moved along the rail 8 to a position near the work center 4. At the position near the work center 4, the hand 13 turns through a specified angle in a horizontal direction such that the arm 46 (i.e., dismounting hand) which holds no tool set is positioned opposite to the punching head 4*a*. The hand 13 then stands by in this condition.

Upon completion of the punching operation by the use of the tool set 27 held at the work center 4, the hand 13 is slightly lowered from the stand-by position. After that, the hand 13 moves in a horizontal direction to allow the lead end of its dismounting hand to be directed forwards and inserted between the punching head 4*a* and the mount table 4*b*. Prior to the tool set replacement by the hand 13, in the work center 4, a die cover 68 (see FIG. 21) disposed so as to enclose the die 30 mounted on the mount table 4*b* is lifted by the amount corresponding to the thickness of the die 30 so that the die 30 can be exposed. The die cover 68 has, at a specified position, notches 68*a* which are formed in order to avoid the interference with the lock pins 56 of the hand 13. The hand 13 is accordingly inserted into the work center 4, of which inserting movement is followed by the pushing-up of the lock pins 56 by the fixed dogs 67. This moves the engagement claws 50*a*, 51, 52*a* into the contact with the V-shaped notches 34*b* of the retaining ring 34, the V-shaped notches 29*b* of the stripper 29 and the V-shaped notches 30*b* of the die 30 respectively, and by the virtue of the energizing forces of the coil springs 55, the tool set 27 is securely held by the engagement claws 50*a*, 51*a* and 52*a*. Then, the retracting movement of the hand 13 causes the tool set 27 to be pulled out of the work center 4, and the lock pins 56 are separated from the fixed dogs 67 when the moving speed of the hand 13 increases. This allows the large diameter parts 56*b* of the lock pins 56 in the lock-pin penetration holes 57, 58 to be placed at the positions corresponding to the gripping pieces 50, 51, 52, thereby locking the movement of the gripping pieces 50, 51, 52. In consequence, even if a shock occurs during acceleration or deceleration of the hand 13, the tool set 27 will not drop off the hand 13.

After the tool set 27 has been accordingly dismounted from the work center 4, the hand 13 turns about the base end through approximately 70° in a horizontal plane so that the arm 46 (i.e., mounting hand) which holds a new tool set 27 to be mounted is placed in a position opposite to the punching head 4*a* and sequentially moved horizontally to be inserted into the punching head 4*a*. After the hand 13 has been inserted between the punching head 4*a* and the mount table 4*b*, the lower ends 56*c* of the lock pins 56 are pushed up by the fixed dogs 67 to bring the engagement claws 50*a*, 51*a*, 52*a* attached to the lead ends of the gripping pieces 50, 51, 52 into the laterally movable condition so that the tool set 27 is released from locking by the gripping pieces 50, 51, 52. Thereafter, the hand 13 moves horizontally to the position that is situated somewhat before (0.2 mm before in this embodiment) the position where the center of the tool set 27 coincides with the axis of the ram.

During the horizontal movement, as shown in FIG. 19, there is a very small gap (=0.3 mm in this embodiment) between the ring contact surface 34*e* of the punch 28 and its associated face, between the contact surface 29*e* of the stripper 29 and its associated face, and between the contact surface 30*e* of the die 30 and its associated face. Therefore, no parts come into contact with the hand 13 during its horizontal movement, causing no touching sound a sound caused by interference). It should be noted that in the condition just after the insertion of the tool set 27, the engagement groove 32*a* of the clamp shank 32 and the projection 61*a* of the engaging member 61 are in close contact with each other and the retaining groove 29*a* of the stripper 29 and the projection 63*a* of the engaging member 63 are in close contact with each other.

After the horizontal movement of the hand 13 toward the specified position, the hand 13 is lowered at a low speed until the contact surface 30*e* of the die 30 comes into contact with its associated face, that is, a die mounting position 4*c*. As mentioned above, since the engagement groove 32*a* of the clamp shank 32 is in close contact with the projection 61*a* of the engaging member 61 while the retaining groove 29*a* of the stripper 29 is in close contact with the projection 63*a*' of the engaging member 63 at that time, the gripping pieces 50, 51 of the hand 13 are slightly opened but the punch 28 and stripper 29 do not move.

After the die contact surface 30*e* has come into contact with the die mounting position 4*c*, the operations of the punch clamp cylinder (not shown), stripper clamp cylinders 64 and die clamp cylinder (not shown) cause the punch clamp claw 62, stripper clamp claws 65 and die clamp claw (not shown) to clamp and fix the clamp shank 32 of the punch 28, the stripper 29 and the die 30 respectively. In such a clamped condition, a very small gap(=0.3 mm in this embodiment) is still kept between the ring contact surface 34*e* of the punch 28 and its associated face and between the contact surface 29*e* of the stripper 29 and its associated face.

Upon the fixing of the punch 28, stripper 29 and die 30 in this way, the hand 13 moves horizontally in a direction opposite to the direction at the time of insertion and, after reaching a specified position, it sequentially moves upward to the aforesaid stand-by position to complete the operation for mounting the tool set 27.

Upon completion of the tool set mounting as described above, a punching operation is performed on the workpiece interposed between the punch 28 and die 30, utilizing the lower movement of the ram. A very small gap (0.3 mm in this embodiment) is created, by the punching force, between the engagement groove 32*a* of the clamp shank 32 and the projection 61*a* of the engaging member 61 which have been in close contact with each other and created, by the pressing force of the stripper 29 against the workpiece, between the retaining groove 29*a* of the stripper 29 and the projection 63*a* of the engaging member 63 which have also been in close contact with each other. On the other hand, the ring contact surface 34*e* of the punch 28 and the contact surface 29*e* of the stripper 29 are brought into close contact with their respective associated faces.

The tool set 27, which has been dismounted by the above-described tool set replacement operation, is put back to the location having its address in the tool set magazine 6 in the way reverse to the operation for taking it from the tool set holder 23.

Figure 28:
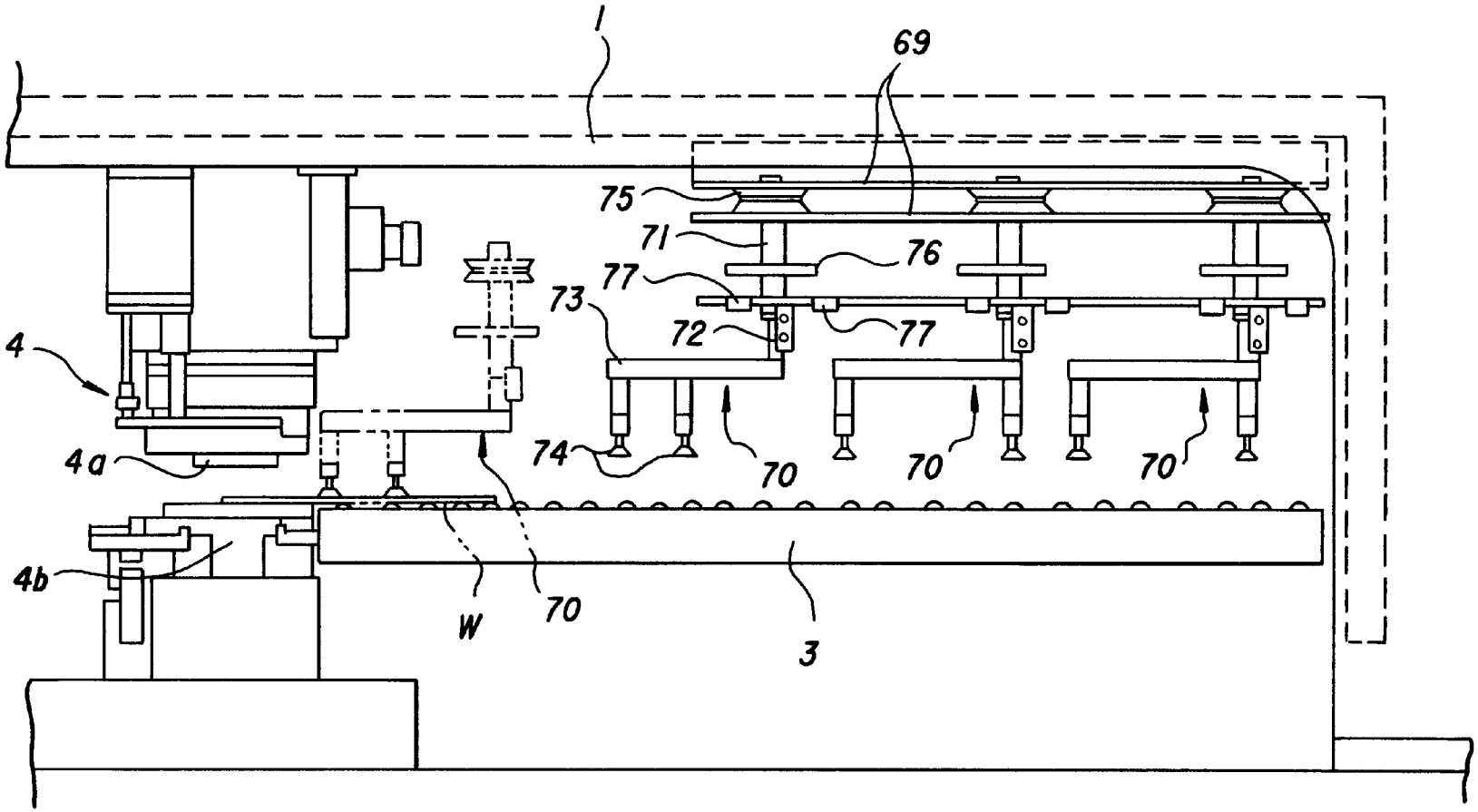

Reference is made to FIG. 28 to describe a discharging mechanism for the materials (products or debris remaining after punching-out) which have been processed in the punching operation at the work center 4.

FIG. 28 shows the discharging mechanism according to an embodiment of the invention, in which two parallel support rails 69 are disposed under the main frame 1 and downstream the work center 4, running in the longitudinal direction of the main frame 1. Supported between the support rails 69 are a plurality of vacuum units 70 (three units in this embodiment). Each vacuum unit 70 comprises (i) an upright strut 71; (ii) a support frame 72 secured to the lower end of the strut 71; (iii) a holder 73 attached to the lower end of the support frame 72; and (iv) vacuum pads 74 (six pads in total) suspending from the holder 73 in two rows. First and second retaining rings 75, 76 are securely attached to the upper end and center of the strut 71, respectively. The first retaining ring 75 has a retaining groove, V-shaped notch and positioning pin (these are not shown) which are identical with the retaining groove 34*a*, V-shaped notches 34*b* and positioning pin 34*c* of the retaining ring 34 in the punch 28, respectively. The second retaining ring 76 has a V-shaped notch identical with the V-shaped notches 30*b* of the die 30. The upper support rail 69 includes notches identical with the notches 35*b*, 35*c* of the tool set receiving member 35 and functioning to engage and hold the upper end of the strut 71 and the positioning pin of the first retaining ring 75. Projected from the lower part of the support frame 72 secured to the main frame 1 toward the support rail 69 are fixed dogs 77 for operating the lock pins 56 of the hand 13 in the same manner as the fixed dogs 45 of the tool set holder 23.

With the above arrangement, the gripping pieces 50, 52 of the hand 13 grip, instead of the tool set 27, the first and second retaining rings 75, 76 of the vacuum unit 70 supported on the support rails 69, and the discharge of the used material W is carried out with each vacuum unit 70.

For starting the discharge of the used material W, the vacuum unit 70 held by the hand 13 is lowered to the absorbing position (indicated by two dot chain line in FIG. 28), while the material W being punched out by the punching head 4*a* and pressed by the stripper 29. The absorption of the material W by the vacuum pads 74 is checked for confirmation and the punching head 4*a* is then lifted. Thereafter, the hand 13 is lifted and then moved until it reaches the projecting position situated beyond one edge of the main frame 1, in order to place the material W onto a material discharge conveyor (not shown).

It is preferable in the embodiment that, when discharging a worn-out tool set which has been used a number of times from the machine or when loading a new tool set into the tool set magazine 6 from outside the machine, the hand 13 be moved to the projecting position (i.e., the position of the hand shown in FIGS. 1 and 2) situated beyond one edge of the main frame 1 and at this projecting position, tool set replacement be, for instance, manually performed.

In the tool set holder 23 of the tool set magazine 6 according to the embodiment, the members of the tool set 27 are held, using the tool set receiving sections 35A, 36A, 38A; notches 35*b*, 35*c*; and other accessories of the tool set receiving members 35 to 39. Instead, of such an arrangement, a retaining device for retaining the tool set 27 may be incorporated in the tool set holder. The tool to be used as the tool set is not necessarily limited to the assembly of the punch 28, stripper 29 and die 30 as mentioned above, but may be a tap tool or other cutting tools as far as they can be used in the work center 4.

According to this embodiment, the circumference of the support shaft 15 is equally divided into 12 parts and the axis of the support shaft 15 into 25 parts, and three hundred tool set holders in total are installed at those parts. However, the number of tool set holders is not limited to this but may be varied as needed.

While the support shaft 15 according to the foregoing embodiment is a hollow shaft with a rectangular cross-section, the cross-section of the support shaft 15 may be of other polygonal shapes.

The stand-by position for the hand 13 during the punching operation in the foregoing embodiment is a specified distance away from the workpiece in an upward direction, but this stand-by position may be separated downwardly from the workpiece as far as the hand 13 does not interfere with the workpiece.

In the foregoing embodiment, the ring contact surface 34*e* of the punch 28 and the contact surface 29*e* of the stripper 29 are brought into close contact with their respective associated faces during the punching operation. The contacting method may be modified in various ways. For example, the parts of the punch 28 and stripper 29, which are pressed during clamping, are tapered and tight contact is achieved when the punch 28 and stripper 29 are clamped by the punch clamp claw 62 and stripper clamp claw 65 respectively. Another alternative is such that the ram is lowered by a specified amount after insertion of the tool set 27 so as to eliminate the gap between the ring contact surface 34*e* of the punch 28 and its associated face and the gap between the contact surface 29*e* of the stripper 29 and its associated face, and thereafter the punch 28 and the stripper 29 are clamped.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Industrial Applicability

The punch press according to the invention is capable of compactly, densely storing a number of tool sets in a tool set magazine and of quickly delivering tool sets between the tool set magazine and the punching head. In addition, all tool sets can be used under the same condition.

The tool set mounting method according to the invention prevents the occurrence of a touching sound at the time of insertion of tool sets and enables high-speed tool set replacement without backlash even if the tool set delivery means is not positioned with high accuracy. Further, damage to the workpiece can be prevented when it is laid over the die during delivery.

We claim:

1. A tool set mounting method for mounting a punch and a die on the tool set mounting section of a punching head, said punch and die being assembled in a set and held by tool set delivery means, the method comprising the steps of:

(a) inserting the tool set delivery means into the tool set mounting section in a horizontal direction with a very small gap between the contact surface of the punch and the corresponding surface of the tool set mounting section opposite to the punch's contact surface and between the contact surface of the die and the corresponding surface of the tool set mounting section opposite to the die's contact surface;

(b) lowering the tool set delivery means after the inserting step in such a direction that the small gap between the contact surface of the die and its corresponding surface of the tool set mounting section opposite to the die's contact surface is eliminated; and (c) pulling the tool set delivery means out of the tool set mounting section in the horizontal direction after the lowering step while leaving the punch and die to be retained in the tool set mounting section.

2. The tool set mounting method as claimed in claim 1, wherein the contact surface of the punch and its corresponding surface of the tool set mounting section opposite to the punch's contact surface are brought into close contact with each other by processing a workpiece with the punch.

3. The tool set mounting method as claimed in claim 1, wherein the contact surface of the punch and its corresponding surface of the tool set mounting section opposite to the punch's contact surface are brought into close contact with each other by retaining the punch in the tool set mounting section.

4. The tool set mounting method as claimed in claim 3, wherein the area of the punch, which is pressed when the punch is retained in the tool set mounting section, is tapered so that the contact surface of the punch can be brought into close contact with the corresponding surface of the tool set mounting section opposite to the punch's surface.

5. The tool set mounting method as claimed in claim 1, wherein the punch is retained in the tool set mounting section after the contact surface of the punch and the corresponding surface of the tool set mounting section are brought into close contact with each other by lowering a ram provided in the tool set mounting section by a specified amount.

* * * * *